US006957701B2

(12) United States Patent
Tolman et al.

(10) Patent No.: US 6,957,701 B2
(45) Date of Patent: Oct. 25, 2005

(54) METHOD AND APPARATUS FOR STIMULATION OF MULTIPLE FORMATION INTERVALS

(75) Inventors: Randy C. Tolman, Marbelton, WY (US); Lawrence O. Carlson, Cypress, TX (US); David A. Kinison, Kingwood, TX (US); Kris J. Nygaard, Houston, TX (US); Glenn S. Goss, Kingwood, TX (US); William A. Sorem, Katy, TX (US); Lee L. Shafer, Big Piney, WY (US)

(73) Assignee: ExxonMobile Upstream Research Company, Houston, TX (US)

( * ) Notice: Subject to any disclaimer, the term of this patent is extended or adjusted under 35 U.S.C. 154(b) by 156 days.

(21) Appl. No.: 10/278,519

(22) Filed: Oct. 23, 2002

(65) Prior Publication Data

US 2003/0051876 A1 Mar. 20, 2003

Related U.S. Application Data

(62) Division of application No. 10/085,518, filed on Feb. 28, 2002, now Pat. No. 6,520,255, which is a continuation of application No. 09/781,597, filed on Feb. 12, 2001, now Pat. No. 6,394,184.

(60) Provisional application No. 06/182,687, filed on Feb. 15, 2000, and provisional application No. 06/244,258, filed on Oct. 30, 2000.

(51) Int. Cl.[7] ..... E21B 43/24; E21B 33/129; E21B 43/119; E21B 43/267

(52) U.S. Cl. ..... 166/281; 166/55.1; 166/120; 166/133; 166/177.5; 166/191; 166/297; 166/308; 166/384; 166/385; 166/386

(58) Field of Search ..... 166/55.1, 120, 166/134, 135, 177.5, 187, 191, 281, 283, 284, 297, 298, 308, 313, 384, 385, 386

(56) References Cited

U.S. PATENT DOCUMENTS

| | | | | |
|---|---|---|---|---|
| 2,067,408 | A | 1/1937 | Morris | 102/4 |
| 2,925,775 | A | 2/1960 | McKee | 102/20 |
| 2,968,243 | A | 1/1961 | Turechek | 102/20 |
| 2,986,214 | A | 5/1961 | Wiseman, Jr. et al. | |
| 3,028,914 | A | 4/1962 | Flickinger | |

(Continued)

FOREIGN PATENT DOCUMENTS

WO WO 02/18743 7/2002

OTHER PUBLICATIONS

Stipp, Louis C. and Williford, R.A. *Pseudolimited Entry: A Sand Fracturing Technique for Simultaneous Treatment of Multiple Pays*, Journal of Petorleum Technology (May 1968) pp. 457–462.

(Continued)

*Primary Examiner*—George Suchfield

(57) ABSTRACT

The invention discloses methods of, as well as apparatus and systems for, perforating and treating multiple intervals of one or more subterranean formations intersected by a wellbore by deploying within said wellbore a bottom-hole assembly ("BHA") having a perforating device and a sealing mechanisms, wherein pressure communication is established between the portions of the wellbore above and below the sealing mechanism. The BHA is positioned within the wellbore such that the sealing mechanism, when actuated, establishes a hydraulic seal in the wellbore to positively force fluid to enter the perforations corresponding to the interval to be treated. A treating fluid is pumped down the wellbore and into the perforations created in the perforated interval. The sealing mechanism is released, and the steps are repeated for as many intervals as desired, without having to remove the BHA from said wellbore.

48 Claims, 18 Drawing Sheets

U.S. PATENT DOCUMENTS

| | | | | |
|---|---|---|---|---|
| 3,111,988 | A | 11/1963 | Davis et al. | |
| 3,118,501 | A | 1/1964 | Kenley | 166/55.4 |
| 3,366,188 | A | 1/1968 | Hicks | 175/4.6 |
| 3,427,652 | A | 2/1969 | Seay | 166/250 |
| 3,429,384 | A | 2/1969 | Shore | 175/4.6 |
| 3,547,198 | A | 12/1970 | Slusser | 166/284 |
| 3,662,833 | A | 5/1972 | Kisling, III | 166/314 |
| 3,712,379 | A | 1/1973 | Hill | 166/297 |
| 3,739,723 | A | 6/1973 | Hakala | 102/20 |
| 3,874,461 | A | 4/1975 | Cocanower | 175/4.6 |
| 4,102,401 | A | 7/1978 | Erbstoesser | 166/284 |
| 4,113,314 | A | 9/1978 | Savanick et al. | 299/4 |
| 4,137,182 | A | 1/1979 | Golinkin | |
| 4,139,060 | A | 2/1979 | Muecke et al. | 166/281 |
| 4,244,425 | A | 1/1981 | Erbstoesser | 166/284 |
| 4,415,035 | A | 11/1983 | Medlin et al. | 166/308 |
| 4,637,468 | A | 1/1987 | Derrick | 166/297 |
| 4,671,352 | A | 6/1987 | Magee, Jr. et al. | 166/186 |
| 4,702,316 | A | 10/1987 | Chung et al. | 166/272 |
| 4,776,393 | A | 10/1988 | Forehand et al. | 166/55.1 |
| 4,809,781 | A | 3/1989 | Hoefner | 166/273 |
| 4,860,831 | A | 8/1989 | Cailier | 166/384 |
| 4,865,131 | A | 9/1989 | Moore et al. | 166/384 |
| 4,867,241 | A | 9/1989 | Strubhar | 166/308 |
| 5,025,861 | A | 6/1991 | Huber et al. | 166/297 |
| 5,103,912 | A | 4/1992 | Flint | 166/297 |
| 5,131,472 | A | 7/1992 | Dees et al. | 166/308 |
| 5,161,618 | A | 11/1992 | Jones et al. | 166/308 |
| 5,309,995 | A | 5/1994 | Gonzalez et al. | 166/284 |
| 5,314,019 | A | 5/1994 | Honarpour | 166/270 |
| 5,353,875 | A | 10/1994 | Schultz et al. | 166/297 |
| 5,390,741 | A | 2/1995 | Payton et al. | 166/284 |
| 5,485,882 | A | 1/1996 | Bailey et al. | 166/284 |
| 5,513,703 | A | 5/1996 | Mills et al. | 166/55.1 |
| 5,579,844 | A | 12/1996 | Rebardi et al. | 166/296 |
| 5,598,891 | A | 2/1997 | Snider et al. | 166/308 |
| 5,669,448 | A | 9/1997 | Minthorn et al. | 166/308 |
| 5,704,426 | A | 1/1998 | Rytlewski et al. | 166/297 |
| 5,755,286 | A | 5/1998 | Ebinger | 166/281 |
| 5,803,178 | A | 9/1998 | Cain | 166/306 |
| 5,812,068 | A | 9/1998 | Wisler et al. | 340/855.5 |
| 5,832,998 | A | 11/1998 | Decker et al. | 166/185 |
| 5,845,712 | A | 12/1998 | Griffith, Jr. | 166/278 |
| 5,865,252 | A | 2/1999 | van Petegem et al. | 166/297 |
| 5,890,536 | A | 4/1999 | Nierode et al. | 166/284 |
| 5,921,318 | A | 7/1999 | Ross | 166/250.17 |
| 5,934,377 | A | 8/1999 | Savage | 166/281 |
| 5,947,200 | A | 9/1999 | Montgomery | 166/281 |
| 5,954,133 | A | 9/1999 | Ross | 166/297 |
| 5,990,051 | A | 11/1999 | Ischy et al. | 507/204 |
| 5,996,687 | A | 12/1999 | Pringle et al. | 166/66.6 |
| 6,003,607 | A | 12/1999 | Hagen et al. | 166/381 |
| 6,012,525 | A | 1/2000 | Burleson et al. | 166/297 |
| 6,053,248 | A | 4/2000 | Ross | 166/297 |
| 6,098,713 | A | 8/2000 | Ross | 166/297 |
| 6,116,343 | A | 9/2000 | Van Petegem et al. | 166/297 |
| 6,131,662 | A | 10/2000 | Ross | 166/369 |
| 6,186,227 | B1 * | 2/2001 | Vaynshteyn et al. | 166/120 |
| 6,186,230 | B1 | 2/2001 | Nierode | 166/250.1 |
| 6,186,236 | B1 | 2/2001 | Cox | 166/308 |
| 6,189,621 | B1 | 2/2001 | Vail, III | 166/385 |
| 6,241,013 | B1 | 6/2001 | Martin | 166/51 |
| 6,257,332 | B1 | 7/2001 | Vidrine et al. | 166/250.15 |
| 6,257,338 | B1 | 7/2001 | Kilgore | 166/387 |
| 6,272,434 | B1 | 8/2001 | Wisler et al. | 702/9 |
| 6,286,598 | B1 | 9/2001 | Van Petegem et al. | 166/297 |
| 6,296,066 | B1 | 10/2001 | Terry et al. | 175/92 |
| 6,394,184 | B2 | 5/2002 | Tolman et al. | 166/281 |
| 6,408,942 | B2 | 6/2002 | Martin | 166/278 |
| 6,446,727 | B1 | 9/2002 | Zemlak et al. | |
| 6,474,419 | B2 | 11/2002 | Maier et al. | 166/387 |
| 6,488,082 | B2 | 12/2002 | Echols et al. | 166/51 |
| 6,494,260 | B2 | 12/2002 | van Petegem et al. | 166/278 |
| 6,497,284 | B2 * | 12/2002 | van Petegem et al. | 166/297 |
| 6,497,290 | B1 | 12/2002 | Misselbrook et al. | 166/384 |
| 6,543,538 | B2 * | 4/2003 | Tolman et al. | 166/297 |
| 6,543,540 | B2 | 4/2003 | Woie et al. | 166/305.1 |
| 6,547,011 | B2 | 4/2003 | Kilgore | 166/387 |
| 2003/0002167 | A1 | 1/2003 | Surjaatmadja et al. | |

OTHER PUBLICATIONS

Williams, B.B., Nieto, G., Graham, H.L., and Leibach R.E. *A Staged Fracturing Treatment for Multisand Intervals*, Journal of Petroleum Technology (Aug. 1973) pp.897–904.

Von Albrecht, C., Diaz, B., Salathiel, W.M., and Nierode, D.E. *Stimulation of Asphaltic Deep Wells and Shallow Wells in Lake Maracaibo, Venezuela, 10th World Petroleum Congress*, PD7, Bucharest, Romania (1979) pp. 55–62.

Warpinski, N.R., Branagan, P.T., Lorenz, J.C., Northrop, D.A., and Frohne, K.H. *Fracturing and Testing Case Study of Paludal, Tight, Lenticular Gas Sands, SPE/DOE 1985 Low Permeability Gas Reservoirs*, Denver, Colorado Paper No. SPE/DEO 13876 (May 9–22, 1985) pp. 267–278.

Sattler, A.R., Hudson, P.J., Raible, C.J., Gall, B.L., and Maloney D.R. *Laboratory Studies for the Design and Analysis of Hydraulic Fractured Stimulations in Lenticular, Tight Gas Reservoirs, Unconventional Gas Technology Symposium*, Louisville, KY, Paper No. SPE 15245 (May 18–21, 1986) pp. 437–447.

Cipolla, Craig L. *Hydraulic Fracture Technology in the Ozona Canyon and Penn Sands, Permian Basin Oil & Gas Recovery Conference*, Midland, Texas, Paper No. SPE 35196 (Mar. 27–29, 1996) pp. 455–466.

Cipolla, Craig L.and Woods, Mike C. *A Statistical Approach to Infill Drilling Studies: Case History of the Ozona Canyon Sands, Gas Technology Conference*, Calgary, Alberta, Canada Paper No. SPE 35628 (Apr. 28–May 1, 1996) pp. 493–497.

Webster, K.R., Goins Jr., w.C. and Berry, S.C. *A Continuous Multistage Fracturing Technique*, Journal of Petroleum Technology (Jun., 1965) pp. 619–625.

Kordziel, Walter R., Rowe, Wayne, Dolan, V.B., and Ritger, Scott D. *A Case Study of Integrating Well–Logs and a Pseudo 3D Multi–Layer Frac Model to Optimize Exploitation of Tight Lenticular Gas Sands, European Petroleum Conference*, Milan Italy, Paper No. SPE 36886 (Oct. 22–24, 1996) pp. 129–141.

Kuuskraa, Vello A., Prestridge, Andrew L., and Hansen, John T. *Advanced Technologies for Producing Massively Stacked Lenticular Sands, Gas Technology Conference*, Calgary, Alberta, Canada, Paper No. SPE 35630 (Apr. 28–May 1, 1996) pp. 505–514.

Bennion, D.B., Thomas, F.B., and Bietz, R.F. *Low Permeability Gas Reservoirs: Problems, Opportunities and Solutions for Drilling, Completion, Stimulation and Production, Gas Technology Conference*, Calgary, Alberta, Canada, Paper No. SPE 35577 (Apr. 28–May 1, 1996) pp. 117–131.

Peterson, R.E. and Kohurt Julie. *An Approximation of Continuity of Lenticular Mesaverde Sandstone Lenses Utilizing Close–Well Correlations, Piceance Basin, Northwestern Colorado, 1983 SPE/DOE Low Permeability Gas Reservoirs*, Denver, Colorado Paper No. SPE/DOE 11610 (Mar. 14016, 1983) pp. 1–5.

Halliburton brochure, "Cobra Frac Service, Coiled Tubing Fracturing–Cost–Effective Method for Stimulating Uptapped Reserves", 2 pages.
Halliburton brochure, "Stimulation, Cobra Frac Service Quick Rig Coiled Tubing Unit Provides Faster Rig Up and Improved Reliability for Enhanced Service Quality", 2 pages.
Halliburton brochure, "CobraJet Frac Service, Cost Effective Technology That Can Help Reduce Cost Per BOF Produced, Shorten Cycle Time and Reduce Capex", 2 pages.
Halliburton brochure, "Stimulation, SurgiFrac Service, A Quick and Cost–Effective Method to Help Boost Production From Openhole Horizontal Completions", 2 pages.

Halliburton brochure, "SurgiFrac Service—Fracture Stimulation Technique for Horizontal Completions in Low– to Medium–Permeability Reservoirs", 6 pages.

* cited by examiner

METHOD AND APPARATUS FOR STIMULATION OF MULTIPLE FORMATION INTERVALS

This application is a divisional application Ser. No. 10/085,518 filed Feb. 28, 2002, now U.S. Pat. No. 6,520,255 which is a continuation of application Ser. No. 09/781,597 filed Feb. 12, 2001, now U.S. Pat. No. 6,394,184 which claims the benefit of U.S. Provisional Patent Application Nos. 60/182,687 filed Feb. 15, 2000 and 60/244,258 filed Oct. 30, 2000.

FIELD OF THE INVENTION

This invention relates generally to the field of perforating and treating subterranean formations to increase the production of oil and gas therefrom. More specifically, the invention provides an apparatus and a method for perforating and treating multiple intervals without the necessity of removing equipment from the wellbore between steps or stages.

BACKGROUND OF THE INVENTION

When a hydrocarbon-bearing, subterranean reservoir formation does not have enough permeability or flow capacity for the hydrocarbons to flow to the surface in economic quantities or at optimum rates, hydraulic fracturing or chemical (usually acid) stimulation is often used to increase the flow capacity. A wellbore penetrating a subterranean formation typically consists of a metal pipe (casing) cemented into the original drill hole. Holes (perforations) are placed to penetrate through the casing and the cement sheath surrounding the casing to allow hydrocarbon flow into the wellbore and, if necessary, to allow treatment fluids to flow from the wellbore into the formation.

Hydraulic fracturing consists of injecting fluids (usually viscous shear thinning, non-Newtonian gels or emulsions) into a formation at such high pressures and rates that the reservoir rock fails and forms a plane, typically vertical, fracture (or fracture network) much like the fracture that extends through a wooden log as a wedge is driven into it. Granular proppant material, such as sand, ceramic beads, or other materials, is generally injected with the later portion of the fracturing fluid to hold the fracture(s) open after the pressure is released. Increased flow capacity from the reservoir results from the easier flow path left between grains of the proppant material within the fracture(s). In chemical stimulation treatments, flow capacity is improved by dissolving materials in the formation or otherwise changing formation properties.

Application of hydraulic fracturing as described above is a routine part of petroleum industry operations as applied to individual target zones of up to about 60 meters (200 feet) of gross, vertical thickness of subterranean formation. When there are multiple or layered reservoirs to be hydraulically fractured, or a very thick hydrocarbon-bearing formation (over about 60 meters), then alternate treatment techniques are required to obtain treatment of the entire target zone. The methods for improving treatment coverage are commonly known as "diversion" methods in petroleum industry terminology.

When multiple hydrocarbon-bearing zones are stimulated by hydraulic fracturing or chemical stimulation treatments, economic and technical gains are realized by injecting multiple treatment stages that can be diverted (or separated) by various means, including mechanical devices such as bridge plugs, packers, downhole valves, sliding sleeves, and baffle/plug combinations; ball scalers; particulates such as sand, ceramic material, proppant, salt, waxes, resins, or other compounds; or by alternative fluid systems such as viscosified fluids, gelled fluids, foams, or other chemically formulated fluids; or using limited entry methods. These and all other methods and devices for temporarily blocking the flow of fluids into or out of a given set of perforations will be referred to herein as "diversion agents."

In mechanical bridge plug diversion, for example, the deepest interval is first perforated and fracture stimulated, then the interval is typically isolated by a wireline-set bridge plug, and the process is repeated in the next interval up. Assuming ten target perforation intervals, treating 300 meters (1,000 feet) of formation in this manner would typically require ten jobs over a time interval of ten days to two weeks with not only multiple fracture treatments, but also multiple perforating and bridge plug running operations. At the end of the treatment process, a wellbore clean-out operation would be required to remove the bridge plugs and put the well on production. The major advantage of using bridge plugs or other mechanical diversion agents is high confidence that the entire target zone is treated. The major disadvantages are the high cost of treatment resulting from multiple trips into and out of the wellbore and the risk of complications resulting from so many operations in the well. For example, a bridge plug can become stuck in the casing and need to be drilled out at great expense. A further disadvantage is that the required wellbore clean-out operation may damage some of the successfully fractured intervals.

One alternative to using bridge plugs is filling the portion of wellbore associated with the just fractured interval with fracturing sand, commonly referred to as the Pine Island technique. The sand column in the wellbore essentially plugs off the already fractured interval and allows the next interval to be perforated and fractured independently. The primary advantage is elimination of the problems and risks associated with bridge plugs. The disadvantages are that the sand plug does not give a perfect hydraulic seal and it can be difficult to remove from the wellbore at the end of all the fracture stimulations. Unless the well's fluid production is strong enough to carry the sand from the wellbore, the well may still need to be cleaned out with a work-over rig or coiled tubing unit. As before, additional wellbore operations increase costs, mechanical risks, and risks of damage to the fractured intervals.

Another method of diversion involves the use of particulate materials, granular solids that are placed in the treating fluid to aid diversion. As the fluid is pumped, and the particulates enter the perforations, a temporary block forms in the zone accepting the fluid if a sufficiently high concentration of particulates is deployed in the flow stream. The flow restriction then diverts fluid to the other zones. After the treatment, the particulate is removed by produced formation fluids or by injected wash fluid, either by fluid transport or by dissolution. Commonly available particulate diverter materials include benzoic acid, napthalene, rock salt (sodium chloride), resin materials, waxes, and polymers. Alternatively, sand, proppant, and ceramic materials, could be used as particulate diverters. Other specialty particulates can be designed to precipitate and form during the treatment.

Another method for diverting involves using viscosified fluids, viscous gels, or foams as diverting agents. This method involves pumping the diverting fluid across and/or into the perforated interval. These fluid systems are formulated to temporarily obstruct flow to the perforations due to viscosity or formation relative permeability decreases; and are also designed so that at the desired time, the fluid system breaks down, degrades, or dissolves (with or without adding chemicals or other additives to trigger such breakdown or dissolution) such that flow can be restored to or from the perforations. These fluid systems can be used for diversion of matrix chemical stimulation treatments and fracture treatments. Particulate diverters and/or ball sealers are sometimes incorporated into these fluid systems in efforts to enhance diversion.

Another possible process is limited entry diversion in which the entire target zone of the formation to be treated is perforated with a very small number of perforations, generally of small diameter, so that the pressure loss across those perforations during pumping promotes a high, internal wellbore pressure. The internal wellbore pressure is designed to be high enough to cause all of the perforated intervals to fracture simultaneously. If the pressure were too low, only the weakest portions of the formation would fracture. The primary advantage of limited entry diversion is that there are no inside-the-casing obstructions like bridge plugs or sand to cause problems later. The disadvantage is that limited entry fracturing often does not work well for thick intervals because the resulting fracture is frequently too narrow (the proppant cannot all be pumped away into the narrow fracture and remains in the wellbore), and the initial, high wellbore pressure may not last. As the sand material is pumped, the perforation diameters are often quickly eroded to larger sizes that reduce the internal wellbore pressure. The net result can be that not all of the target zone is stimulated. An additional concern is the potential for flow capacity into the wellbore to be limited by the small number of perforations.

Some of the problems resulting from failure to stimulate the entire target zone or using mechanical methods that require multiple wellbore operations and wellbore entries that pose greater risk and cost as described above may be alleviated by using limited, concentrated perforated intervals diverted by ball sealers. The zone to be treated could be divided into sub-zones with perforations at approximately the center of each of those sub-zones, or sub-zones could be selected based on analysis of the formation to target desired fracture locations. The fracture stages would then be pumped with diversion by ball sealers at the end of each stage. Specifically, 300 meters (1,000 feet) of gross formation might be divided into ten sub-zones of about 30 meters (about 100 feet) each. At the center of each 30 meter (100 foot) sub-zone, ten perforations might be shot at a density of three shots per meter (one shot per foot) of casing. A fracture stage would then be pumped with proppant-laden fluid followed by ten or more ball sealers, at least one for each open perforation in a single perforation set or interval. The process would be repeated until all of the perforation sets were fractured. Such a system is described in more detail in U.S. Pat. No. 5,890,536, issued Apr. 6, 1999.

Historically, all zones to be treated in a particular job that uses ball sealers as the diversion agent have been perforated prior to pumping treatment fluids, and ball sealers have been employed to divert treatment fluids from zones already broken down or otherwise taking the greatest flow of fluid to other zones taking less, or no, fluid prior to the release of ball sealers. Treatment and sealing theoretically proceeded zone by zone depending on relative breakdown pressures or permeabilities, but problems were frequently encountered with balls prematurely seating on one or more of the open perforations outside the targeted interval and with two or more zones being treated simultaneously. Furthermore, this technique presumes that each perforation interval or sub-zone would break down and fracture at sufficiently different pressure so that each stage of treatment would enter only one set of perforations.

The primary advantages of ball sealer diversion are low cost and low risk of mechanical problems. Costs are low because the process can typically be completed in one continuous operation, usually during just a few hours of a single day. Only the ball sealers are left in the wellbore to either flow out with produced hydrocarbons or drop to the bottom of the well in an area known as the rat (or junk) hole. The primary disadvantage is the inability to be certain that only one set of perforations will fracture at a time so that the correct number of ball sealers are dropped at the end of each treatment stage. In fact, optimal benefit of the process depends on one fracture stage entering the formation through only one perforation set and all other open perforations remaining substantially unaffected during that stage of treatment. Further disadvantages are lack of certainty that all of the perforated intervals will be treated and of the order in which these intervals are treated while the job is in progress. When the order of zone treatment is not known or controlled, it is not possible to ensure that each individual zone is treated or that an individual stimulation treatment stage has been optimally designed for the targeted zone. In some instances, it may not be possible to control the treatment such that individual zones are treated with single treatment stages.

To overcome some of the disadvantages that may occur during stimulation treatments when multiple zones are perforated prior to pumping treatment fluids, an alternative mechanical diversion method has been developed that involves the use of a coiled tubing stimulation system to sequentially stimulate multiple intervals with separate treatment. As with conventional ball sealer diversion, all intervals to be treated are perforated prior to pumping the stimulation treatment. Then coiled tubing is run into the wellbore with a mechanical "straddle-packer-like" diversion tool attached to the end. This diversion tool, when properly placed and actuated across the perforations, allows hydraulic isolation to be achieved above and below the diversion tool. After the diversion tool is placed and actuated to isolate the deepest set of perforations, stimulation fluid is pumped down the interior of the coiled tubing and exits flow ports placed in the diversion tool between the upper and lower sealing elements. Upon completion of the first stage of treatment, the sealing elements contained on the diversion tool are deactivated or disengaged, and the coiled tubing is pulled upward to place the diversion tool across the second deepest set of perforations and the process is continued until all of the targeted intervals have been stimulated or the process is aborted due to operational upsets.

This type of coiled tubing stimulation apparatus and method have been used to hydraulically fracture multiple zones in wells with depths up to about 8,000 feet. However, various technical obstacles, including friction pressure losses, damage to sealing elements, depth control, running speed, and potential erosion of coiled tubing, currently limit deployment in deeper wells.

Excess friction pressure is generated when pumping stimulation fluids, particularly proppant-laden and/or high viscosity fluids, at high rates through longer lengths of coiled tubing. Depending on the length and diameter of the coiled tubing, the fluid viscosity, and the maximum allowable surface hardware working pressures, pump rates could be limited to just a few barrels per minute; which, depending on the characteristics of a specific subterranean formation, may not allow effective placement of proppant during hydraulic fracture treatments or effective dissolution of formation materials during acid stimulation treatments Erosion of the coiled tubing could also be a problem as proppant-laden fluid is pumped down the interior of the coiled tubing at high velocity, including the portion of the coiled tubing that remains wound on the surface reel. The erosion concerns are exacerbated as the proppant-laden fluid impinges on the "continuous bend" associated with the portion of the coiled tubing placed on the surface reel.

Most seal elements (e.g., "cup" seal technology) currently used in the coiled tubing stimulation operations described above could experience sealing problems or seal failure in deeper wells as the seals are run past a large number of perforations at the higher well temperatures associated with deeper wells. Since the seals run in contact with or at a minimal clearance from the pipe wall, rough interior pipe surfaces and/or perforation burrs can damage the sealing elements. Seals currently available in straddle-packer-like diversion tools are also constructed from elastomers which may be unable to withstand the higher temperatures often associated with deeper wells.

Running speed of the existing systems with cup seals is generally on the order of 15 to 30 feet-per-minute running downhole to 30 to 60 feet-per-minute coming uphole. For example, at the lower running speed, approximately 13 hours would be required to reach a depth of 12,000 feet before beginning the stimulation. Given safety issues surrounding nighttime operations, this slow running speed could result in multiple days being required to complete a stimulation job. If any problems are encountered during the job, tripping in and out of the hole could be very costly because of the total operation times associated with the slow running speeds.

Depth control of the coiled tubing system and straddle-packer-like diversion tool also becomes more difficult as depth increases, such that placing the tool at the correct depth to successfully execute the stimulation operation may be difficult. This problem is compounded by shooting the perforations before running the coiled tubing system in the hole. The perforating operation uses a different depth measurement device (usually a casing collar locator system) than is generally used in the coiled tubing system.

In addition, the coiled tubing method described above requires that all of the perforations be placed in the wellbore in a separate perforating operation prior to pumping the stimulation job. The presence of multiple perforation sets open above the diversion tool can cause operational difficulties. For example, if the proppant fracture from the current zone were to grow vertically and/or poor quality cement is present behind pipe, the fracture could intersect the perforation sets above the diversion tool such that proppant could "dump" back into the wellbore on top of the diversion tool and prevent further tool movement. Also, it could be difficult to execute circulation operations if multiple perforation sets are open above the diversion tool. For example, if the circulation pressures exceed the breakdown pressures associated with the perforations open above the diversion tool, the circulation may not be maintained with circulation fluid unintentionally lost to the formation.

A similar type of stimulation operation may also be performed using jointed tubing and a workover rig rather than a coiled tubing system. Using a diversion tool deployed on jointed tubing may allow for larger diameter tubing to reduce friction pressure losses and allow for increased pump rates. Also, concerns over erosion and tubing integrity may be reduced when compared to coiled tubing since heavier wall thickness jointed tubing pipe may be used and jointed tubing would not be exposed to plastic deformation when run in the wellbore. However, using this approach would likely increase the time and cost associated with the operations because of slower pipe running speeds than those possible with coiled tubing.

To overcome some of the limitations associated with completion operations that require multiple trips of hardware into and out of the wellbore to perforate and stimulate subterranean formations, methods have been proposed for "single-trip" deployment of a downhole tool string to allow for fracture stimulation of zones in conjunction with perforating. Specifically, these methods propose operations that may minimize the number of required wellbore operations and time required to complete these operations, thereby reducing the stimulation treatment cost. These proposals include 1) having a sand slurry in the wellbore while perforating with overbalanced pressure, 2) dumping sand from a bailer simultaneously with firing the perforating charges, and 3) including sand in a separate explosively released container. These proposals all allow for only minimal fracture penetration surrounding the wellbore and are not adaptable to the needs of multi-stage hydraulic fracturing as described herein.

Accordingly, there is a need for an improved method and apparatus for individually treating each of multiple intervals of a subterranean formation penetrated by a wellbore while maintaining the economic benefits of multi-stage treatment. There is also a need for a method and apparatus that can economically reduce the risks inherent in the currently available stimulation treatment options for hydrocarbon-bearing formations with multiple or layered reservoirs or with thickness exceeding about 60 meters (200 feet) while ensuring that optimal treatment placement is performed with a mechanical diversion agent that positively directs treatment stages to the desired location.

SUMMARY OF THE INVENTION

A method of perforating and treating multiple intervals of one or more subterranean formations intersected by a wellbore is disclosed, said method comprising: (a) deploying a bottom-hole assembly ("BHA") using deployment means within said wellbore, said BHA having a perforating device, a sealing mechanism and at least one pressure equalization means; (b) using said perforating device to perforate an interval of said one or more subterranean formations; (c) actuating said sealing mechanism so as to establish a hydraulic seal in said wellbore; (d) pumping a treating fluid in said wellbore and into the perforations created by said perforating device, without removing said perforating device from said wellbore; (e) establishing pressure communication between the portions of the wellbore above and below said sealing mechanism through said at least one pressure equalization means; (f) releasing said sealing mechanism; and (g) repeating steps (b) through (f) for at least one additional interval of said one or more subterranean formations.

In another embodiment, a stimulation treatment system is disclosed for use in perforating and treating multiple intervals of one or more subterranean formations intersected by a wellbore, said system comprising: (a) a treating fluid; (b) a deployment means deployed within said wellbore; (c) a bottom-hole assembly (BHA) adapted to be deployed in said wellbore with said deployment means, said BHA having at least one perforating device for sequentially perforating said multiple intervals, at least one sealing mechanism, and at least one pressure equalization means, said BHA capable of being positioned within said wellbore, to allow actuation of said perforating device, said sealing mechanism and said pressure equalization means; (d) said sealing mechanism capable of establishing a hydraulic seal in said wellbore, said pressure equalization means capable of establishing pressure communication between portions of said wellbore above and below said sealing mechanism, and said sealing mechanism further capable of releasing said hydraulic seal to allow said BHA to move to a different position within said wellbore, thereby allowing each of said multiple treatment intervals to be treated with said treating fluid separately from said other treatment intervals.

In a further embodiment, an apparatus is disclosed for use in perforating and treating multiple intervals of one or more subterranean formations intersected by a wellbore, said apparatus comprising: (a) a bottom-hole assembly (BHA), adapted to be deployed in said wellbore by a deployment means, said BHA having at least one perforating device for sequentially perforating said multiple intervals, at least one sealing mechanism and at least one pressure equalization means; and (b) said sealing mechanism capable of establishing a hydraulic seal in said wellbore, said pressure equalization means capable of establishing pressure communication between portions of said wellbore above and below said sealing mechanism, and said sealing mechanism further capable of releasing said hydraulic seal to allow said BHA to move to a different position within said wellbore, thereby allowing each of said multiple treatment intervals to be treated separately from said other treatment intervals.

BRIEF DESCRIPTION OF THE DRAWINGS

The present invention and its advantages will be better understood by referring to the following detailed description and the attached drawings in which:

FIG. 1 also illustrates representative bottomhole assembly storage wellbores with surface slips that may be used for storage of spare or contingency bottomhole assemblies.

FIG. 2A further illustrates that the bottomhole assembly consists of a perforating device, an inflatable, re-settable packer, a re-settable axial slip device, and ancillary components.

In FIG. 2C, the sealing mechanism is shown in a de-activated position since, for illustration purposes only, it is assumed that no other perforations besides those associated with the first zone are present, and as such, isolation is not necessary for treatment of the first zone.

FIG. 4A also represents the coiled tubing, and wellbore of FIG. 3F after an additional, third perforating and fracture stimulation operation has been performed. In FIG. 4A, it is noted that only the second and third fractures and perforation sets are shown. In FIG. 4A, the modified bottomhole assembly is shown suspended by coiled tubing such that the location of the bridge-plug is located above the last perforated interval and below the next interval to be perforated.

DETAILED DESCRIPTION OF THE INVENTION

Figure 1:
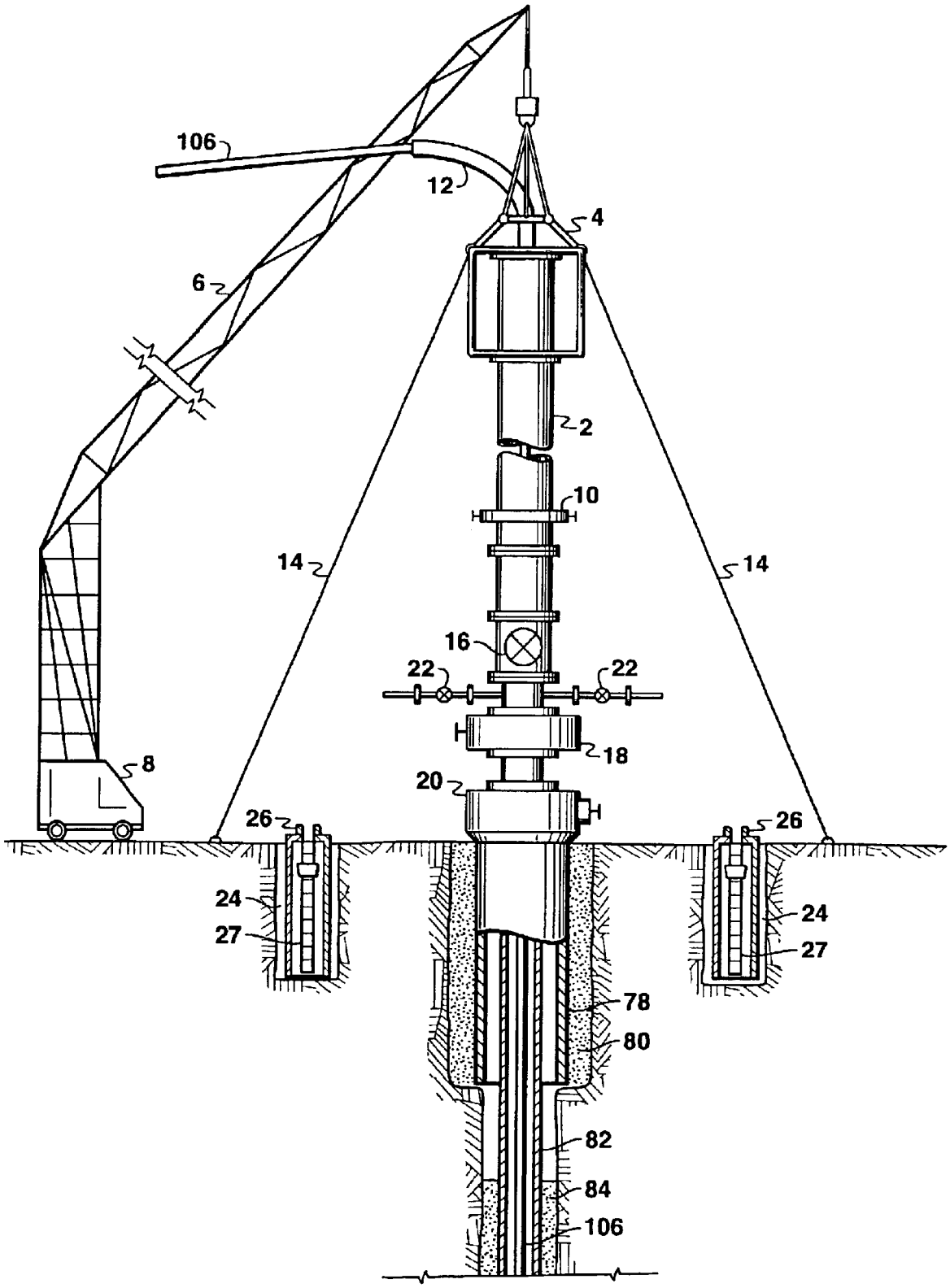
FIG. 1 illustrates one possible representative wellbore configuration with peripheral equipment that could be used to support the bottomhole assembly used in the present invention.

The present invention will be described in connection with its preferred embodiments. However, to the extent that the following description is specific to a particular embodiment or a particular use of the invention, this is intended to be illustrative only, and is not to be construed as limiting the scope of the invention. On the contrary, the description is intended to cover all alternatives, modifications, and equivalents that are included within the spirit and scope of the invention, as defined by the appended claims.

The present invention provides a new method, new system, and a new apparatus for perforating and stimulating multiple formation intervals, which allows each single zone to be treated with an individual treatment stage while eliminating or minimizing the problems that are associated with existing coiled tubing or jointed tubing stimulation methods and hence providing significant economic and technical benefit over existing methods.

Specifically, the invention involves suspending a bottomhole assembly in the wellbore to individually and sequentially perforate and treat each of the desired multiple zones while pumping the multiple stages of the stimulation treatment and to deploy a mechanical re-settable sealing mechanism to provide controlled diversion of each individual treatment stage. For the purposes of this application, "wellbore" will be understood to include below ground sealed components of the well and also all sealed equipment above ground level, such as the wellhead, spool pieces, blowout preventers, and lubricator.

The new apparatus consists of a deployment means (e.g., coiled tubing, jointed tubing, electric line, wireline, tractor system, etc.) with a bottomhole assembly comprised of at least a perforating device and a re-settable mechanical sealing mechanism that may be independently actuated from the surface via one or more signaling means (e.g., electronic signals transmitted via wireline; hydraulic signals transmitted via tubing, annulus, umbilicals; tension or compression loads; radio transmission; fiber-optic transmission; etc.) and designed for the anticipated wellbore environment and loading conditions.

In the most general sense, the term "bottomhole assembly" is used to denote a string of components consisting of at least a perforating device and a re-settable sealing mechanism. Additional components including, but not limited to, fishing necks, shear subs, wash tools, circulation port subs, flow port subs, pressure equalization port subs, temperature gauges, pressure gauges, wireline connection subs, re-settable mechanical slips, casing collar locators, centralizer subs and/or connector subs may also be placed on the bottomhole assembly to facilitate other anticipated auxiliary or ancillary operations and measurements that may be desirable during the stimulation treatment.

In the most general sense, the re-settable mechanical sealing mechanism performs the function of providing a "hydraulic seal", where hydraulic seal is defined as sufficient flow restriction or blockage such that fluid is forced to be directed to a different location than the location it would otherwise be directed to if the flow restriction were not present. Specifically, this broad definition for "hydraulic seal" is meant to include a "perfect hydraulic seal" such that all flow is directed to a location different from the location the flow would be directed to if the flow restriction were not present; and an "imperfect hydraulic seal" such that an appreciable portion of flow is directed to a location different from the location the flow would be directed to if the flow restriction were not present. Although it would generally be preferable to use a re-settable mechanical sealing that provides a perfect hydraulic seal to achieve optimal stimulation; a sealing mechanism that provides an imperfect hydraulic seal could be used and an economic treatment achieved even though the stimulation treatment may not be perfectly diverted.

In the first preferred embodiment of the invention, coiled tubing is used as the deployment means and the new method involves sequentially perforating and then stimulating the individual zones from bottom to top of the completion interval, with the stimulation fluid pumped down the annular space between the production casing and the coiled tubing. As discussed further below, this embodiment of the new apparatus and method offer substantial improvements over existing coiled tubing and jointed tubing stimulation technology and are applicable over a wide range of wellbore architectures and stimulation treatment designs.

Specifically, the first preferred embodiment of the new method and apparatus involves the deployment system, signaling means, bottomhole assembly, and operations as described in detail below, where the various components, their orientation, and operational steps are chosen, for descriptive purposes only, to correspond to components and operations that could be used to accommodate hydraulic proppant fracture stimulation of multiple intervals.

In the first preferred embodiment for a hydraulic proppant fracture stimulation treatment, the apparatus would consist of the BHA deployed in the wellbore by coiled tubing. The BHA would include a perforating device; re-settable mechanical sealing mechanism; casing-collar-locator; circulation ports; and other ancillary components (as described in more detail below).

Furthermore, in this first preferred embodiment, the perforating device would consist of a select-fire perforating gun system (using shaped-charge perforating charges); and the re-settable mechanical sealing mechanism would consist of an inflatable, re-settable packer; a mechanical re-settable slip device to prevent downward axial movement of the bottomhole assembly when set; and pressure equalization ports located above and below the inflatable re-settable packer.

In addition, in this first preferred embodiment, a wireline would be placed interior to the coiled tubing and used to provide a signaling means for actuation of select-fire perforation charges and for transmission of electric signals associated with the casing-collar-locator used for BHA depth measurement.

Referring now to FIG. 1, an example of the type of surface equipment that could be utilized in the first preferred embodiment would be a rig up that used a very long lubricator 2 with the coiled tubing injector head 4 suspended high in the air by crane arm 6 attached to crane base 8. The wellbore would typically comprise a length of a surface casing 78 partially or wholly within a cement sheath 80 and a production casing 82 partially or wholly within a cement sheath 84 where the interior wall of the wellbore is composed of the production casing 82. The depth of the wellbore would preferably extend some distance below the lowest interval to be stimulated to accommodate the length of the bottomhole assembly that would be attached to the end of the coiled tubing 106. Coiled tubing 106 is inserted into the wellbore using the coiled tubing injection head 4 and lubricator 2. Also installed to the lubricator 2 are blow-out-preventors 10 that could be remotely actuated in the event of operational upsets. The crane base 8, crane arm 6, coiled tubing injection head 4, lubricator 2, blow-out-preventors 10 (and their associated ancillary control and/or actuation components) are standard equipment components well known to those skilled in the art that will accommodate methods and procedures for safely installing a coiled tubing bottomhole assembly in a well under pressure, and subsequently removing the coiled-tubing bottomhole assembly from a well under pressure.

With readily-available existing equipment, the height to the top of the coiled tubing injection head 4 could be approximately 90 feet from ground level with the "gooseneck" 12 (where the coil is bent over to go down vertically into the well) approaching approximately 105 feet above the ground. The crane arm 6 and crane base 8 would support the load of the injector head 4, the coiled tubing 106, and any load requirements anticipated for potential fishing operations (jarring and pulling).

In general, the lubricator 2 must be of length greater than the length of the bottomhole assembly to allow the bottomhole assembly to be safely deployed in a wellbore under pressure. Depending on the overall length requirements and as determined prudent based on engineering design calculations for a specific application, to provide for stability of the coiled tubing injection head 4 and lubricator 2, guy-wires 14 could be attached at various locations on the coiled tubing injection head 4 and lubricator 2. The guy wires 14 would be firmly anchored to the ground to prevent undue motion of the coiled tubing injection head 4 and lubricator 2 such that the integrity of the surface components to hold pressure would not be compromised. Depending on the overall length requirements, alternative injection head/lubricator system suspension systems (coiled tubing rigs or fit-for-purpose completion/workover rigs) could also be used.

Also shown in FIG. 1 are several different wellhead spool pieces which may be used for flow control and hydraulic isolation during rig-up operations, stimulation operations, and rig-down operations. The crown valve 16 provides a device for isolating the portion of the wellbore above the crown valve 16 from the portion of the wellbore below the crown valve 16. The upper master fracture valve 18 and lower master fracture valve 20 also provide valve systems for isolation of wellbore pressures above and below their respective locations. Depending on site-specific practices and stimulation job design, it is possible that not all of these isolation-type valves may actually be required or used.

The side outlet injection valves 22 shown in FIG. 1 provide a location for injection of stimulation fluids into the wellbore. The piping from the surface pumps and tanks used for injection of the stimulation fluids would be attached with appropriate fittings and/or couplings to the side outlet injection valves 22. The stimulation fluids would then be pumped into the wellbore via this flow path. With installation of other appropriate flow control equipment, fluid may also be produced from the wellbore using the side outlet injection valves 22. It is noted that the interior of the coiled tubing 106 can also be used as a flow conduit for fluid injection into the wellbore.

The bottomhole assembly storage wellbores 24 shown in FIG. 1 provide a location for storage of spare or contingency bottom-hole assemblies 27, or for storage of bottomhole assemblies that have been used during previous operations. The bottomhole assembly storage wellbores 24 may be drilled to a shallow depth such that a bottomhole assembly that may contain perforating charges may be safely held in place with surface slips 26 such that the perforating charges are located below ground level until the bottomhole assembly is ready to be attached to the coiled tubing 106. The bottomhole assembly storage wellbores 24 may be drilled to accommodate placement of either cemented or uncemented casing string, or may be left uncased altogether. The actual number of bottomhole assembly storage wellbores 24 required for a particular operation would depend on the overall job requirements. The bottomhole assembly storage wellbores 24 could be located within the reach of the crane arm 6 to accommodate rapid change-out of bottomhole assemblies during the course of the stimulation operation without the necessity of physically relocating the crane base 8 to another location.

Figure 2A:
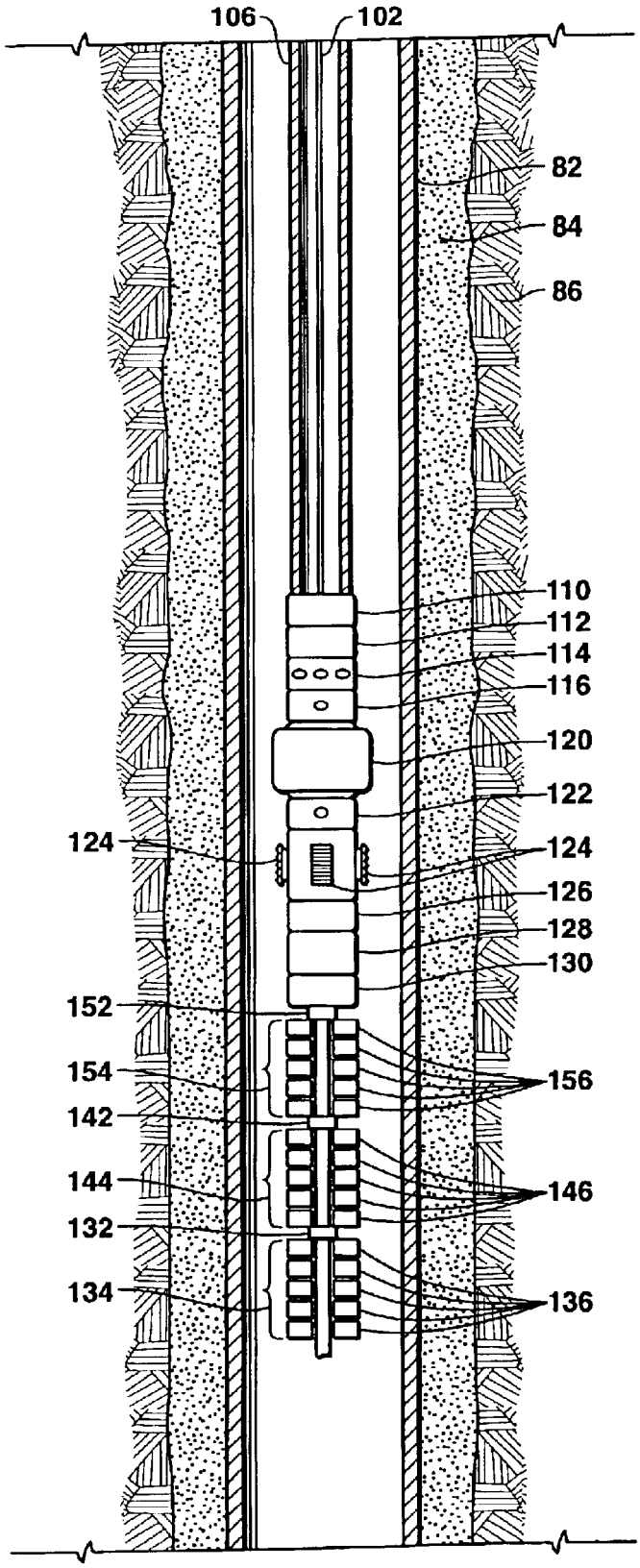
FIG. 2A illustrates the first embodiment of the bottomhole assembly deployed using coiled tubing in an unperforated wellbore and positioned at the depth location to be perforated by the first set of selectively-fired perforating charges.

Referring now to FIG. 2A, coiled tubing 106 is equipped with a coiled tubing connection 110 which may be connected to a shear-release/fishing neck combination sub 112 that contains both a shear-release mechanism and a fishing neck and allows for the passage of pressurized fluids and wireline 102. The shear-release/fishing neck combination sub 112 may be connected to a sub containing a circulation port sub 114 that may provide a flow path to wash debris from above the inflatable, re-settable packer 120 or provide a flow path to inject fluid downhole using the coiled tubing 106. The circulation port sub 114 contains a valve assembly that actuates the circulation port 114 and the upper equalization port 116. The upper equalization port 116 may be connected to a lower equalization port 122 via tubing through the inflatable, re-settable packer 120. Both the circulation port 114 and the upper equalization port 116 would preferably be open in the "running position", thereby allowing pressure communication between the internal coiled-tubing pressure and the coiled tubing by casing annulus pressure. Within this document, "running position" refers to the situation where all components in the bottomhole assembly possess a configuration that permits unhindered axial movement up and down the wellbore. The lower equalization port 122 located below the inflatable, re-settable packer 120 is always open and flow through the equalization ports is controlled by the upper equalization port 116. The circulation and equalization ports can be closed simultaneously by placing a slight compressive load on the BHA. To prevent potential back-flow into the coiled tubing when the circulation port 114 is open in the running position, a surface pressure can be applied to the coiled tubing 106 such that the pressure inside the circulation port 114 exceeds the wellbore pressure directly outside the circulation port 114. The re-settable, inflatable packer 120 is hydraulically isolated from the internal coiled tubing pressure in the running position. The inflatable, re-settable packer 120 can gain pressure communication via internal valving with the internal coiled tubing pressure by placing a slight compressive load on the BHA. Mechanically actuated, re-settable axial position locking devices, or "slips," 124 may be placed below the inflatable, re-settable packer 120 to resist movement down the wellbore. The mechanical slips 124 may be actuated through a "continuous J" mechanism by cycling the axial load between compression and tension. A wireline connection sub 126 is located above the casing collar locator 128 and select-fire perforating gun system. A gun connection sub 130 connects the casing collar locator 128 to select-fire head 152. The perforating gun system may be designed based on knowledge of the number, location, and thickness of the hydrocarbon-bearing sands within the target zones. The gun system will be composed of one gun assembly (e.g., 134) for each zone to be treated. The first (lowest) gun assembly will consist of a select-fire head 132 and a gun encasement 134 which will be loaded with perforating charges 136 and a select-fire detonating system.

Specifically, a preferred embodiment of the new method involves the following steps, where the stimulation job is chosen, for descriptive purposes, to be a multi-stage, hydraulic, proppant-fracture stimulation.

Figure 2B:
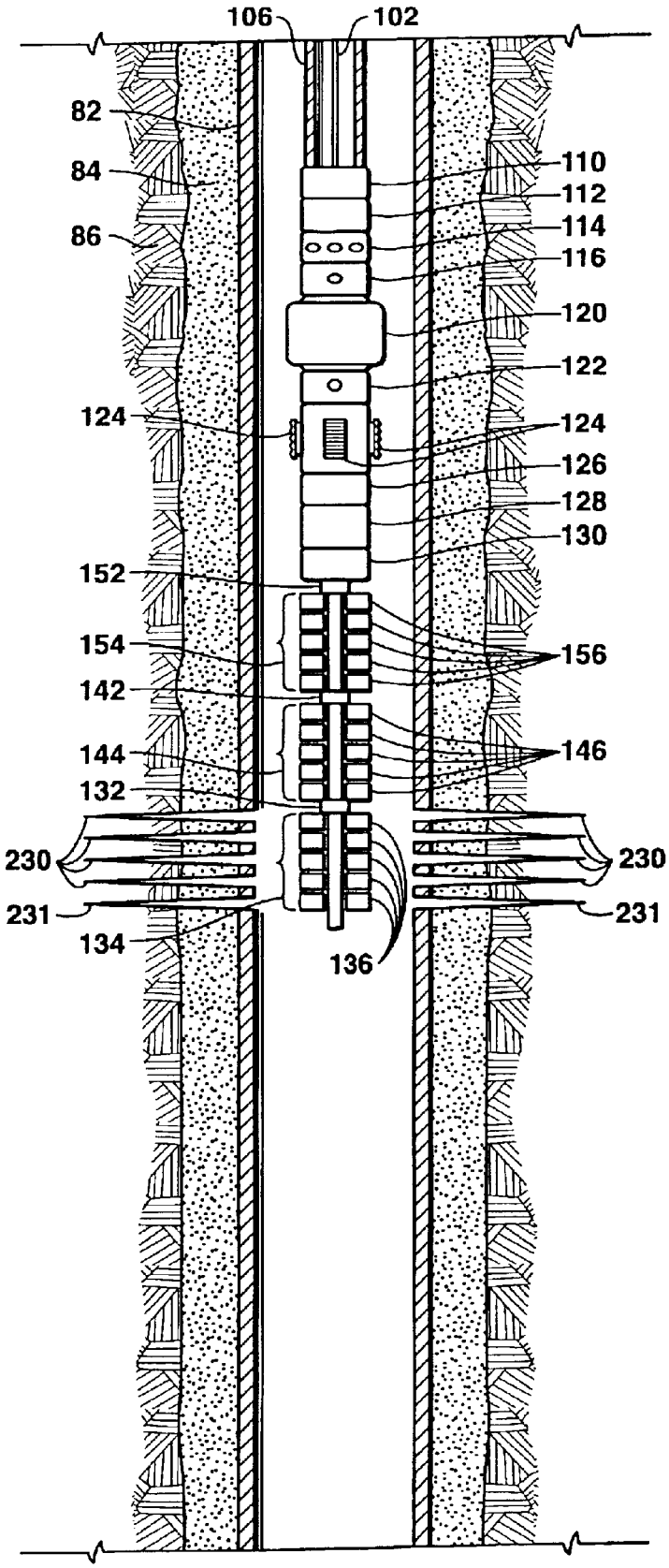
FIG. 2B represents the bottomhole assembly, coiled tubing, and wellbore of FIG. 2A after the first set of selectively-fired perforating charges are fired resulting in perforation holes through the production casing and cement sheath and into the first formation zone such that hydraulic communication is established between the wellbore and the first formation zone.
Figure 2C:
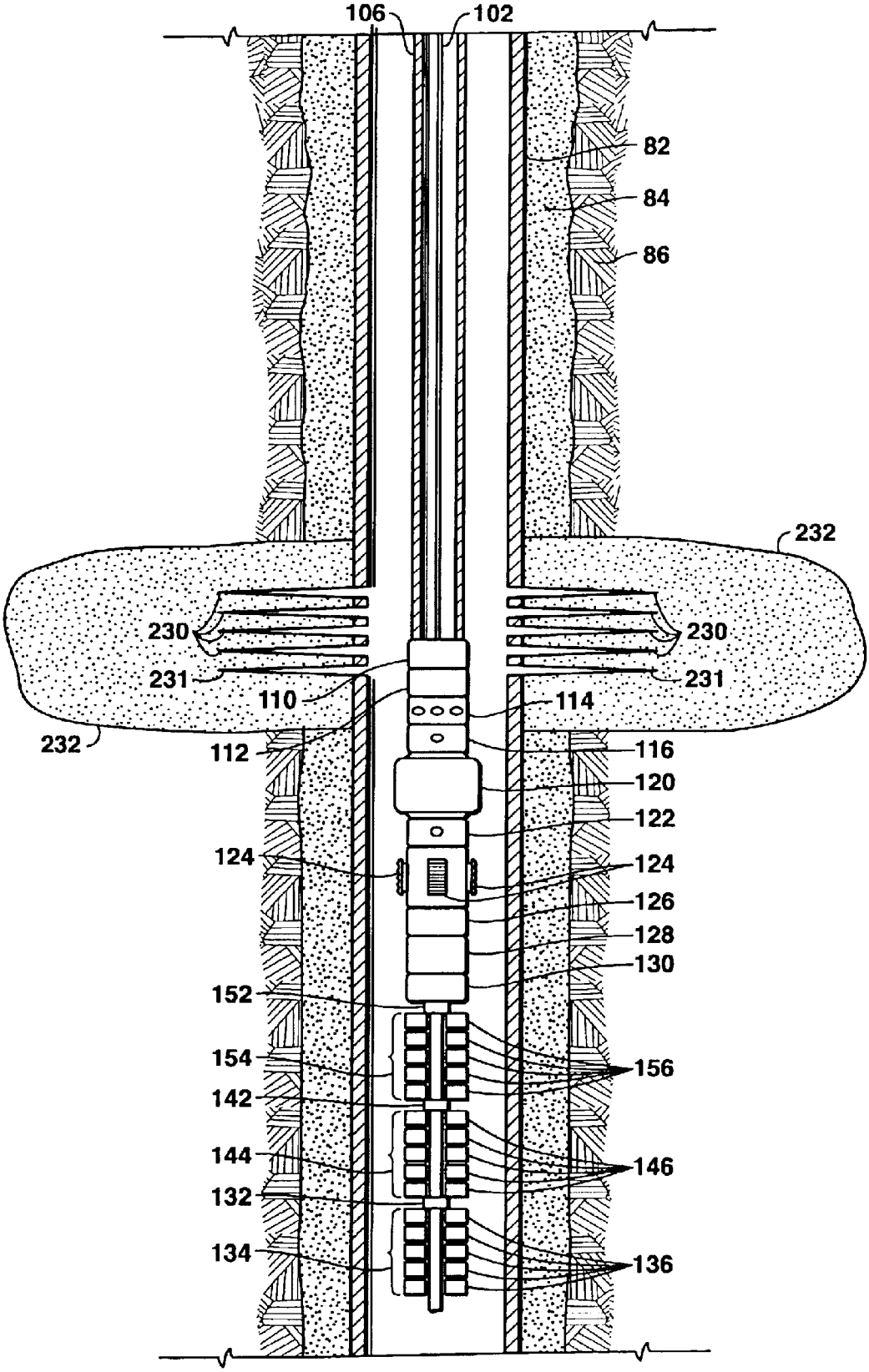
FIG. 2C represents the bottomhole assembly, coiled tubing, and wellbore of FIG. 2B after the bottomhole assembly has been re-positioned and the first formation zone stimulated with the first stage of the multiple-stage, hydraulic, proppant fracture treatment where the first stage of the fracture treatment was pumped downhole in the wellbore annulus existing between the coiled tubing and production casing.

1. The well is drilled and casing is cemented across the interval to be completed, and if desired, one or more bottomhole assembly storage wellbores are drilled and completed.
2. The target zones within the completion interval are identified (typically by a combination of open-hole and cased-hole logs).
3. The bottomhole assemblies (BHA), and perforating gun assemblies to be deployed on each BHA anticipated to be used during the stimulation operation, are designed based on knowledge of the number, location, and thickness of the hydrocarbon-bearing sands within the target zones.
4. A reel of coiled tubing is made-up with a preferred embodiment BHA described above. The reel of coiled tubing would also be made-up to contain the wireline that is used to provide a signaling means for actuation of the perforating guns. Preferably, the desired quantity of appropriately configured spare or contingency BHA's would also be made-up and stored in the bottomhole assembly storage wellbore(s). The coiled tubing may be pre-loaded with fluid either before or after attaching the BHA to the coiled tubing.
5. As shown in FIG. 1, the coiled tubing 106 with BHA is run into the well via a lubricator 2 and the coiled tubing injection head 4 is suspended by crane arm 6.
6. The coiled tubing/BHA is run into the well while correlating the depth of the BHA with the casing collar locator 128 (FIG. 2A).
7. The coiled tubing/BHA is run below the bottom-most target zone to ensure that there is sufficient wellbore depth below the bottom-most perforations to locate the BHA below the first set of perforations during fracturing operations. As shown in FIG. 2A, the inflatable, re-settable packer 120 and re-settable mechanically actuated slips 124 are in the running position.
8. As shown in FIG. 2B, the coiled tubing/BHA is then raised to a location within the wellbore such that the first (lowest) set of perforation charges 136 contained on the first gun assembly 134 of the select-fire perforating gun system are located directly across the bottom-most target zone where precise depth control may be established based on readings from the casing-collar-locator 128 and coiled tubing odometer systems (not shown). The action of moving the BHA up to the location of the first perforated interval will cycle the mechanical slip "continuous J" mechanism (not shown) into the pre-lock position where subsequent downward motion will force the re-settable mechanical slip 124 into the locked position thereby preventing further downward movement. It is noted that additional cycling of the coiled tubing axial load from compression to tension and back will return the re-settable mechanical slips to running position. In this manner, the mechanical slip continuous J mechanism coupled with the use of compression and tension loads transmitted via the suspension means (coiled tubing) are used to provide downhole actuation and de-actuation of the mechanical slips.
9. The first set of perforation charges 136 are selectively-fired by remote actuation via wireline 102 communication with the first select-fire head 132 to penetrate the casing 82 and cement sheath 84 and establish hydraulic communication with the formation 86 through the resultant perforations 230–231. It will be understood that any given set of perforations can, if desired, be a set of one, although generally multiple perforations would provide improved treatment results. It will also be understood that more than one segment of the gun assembly may be fired if desired to achieve the target number of perforations whether to remedy an actual or perceived misfire or simply to increase the number of perforations. It will also be understood that an interval is not necessarily limited to a single reservoir sand. Multiple sand intervals could be perforated and treated as a single stage using other diversion agents suitable for simultaneous deployment with this invention within a given stage of treatment.
10. As shown in FIG. 2C, the coiled tubing may be moved to position the circulation port 114 directly below the deepest perforation 231 of this first target zone to minimize potential for proppant fill above the inflatable, re-settable packer 120 and minimize high velocity proppant flow past the BHA.

Figure 3A:
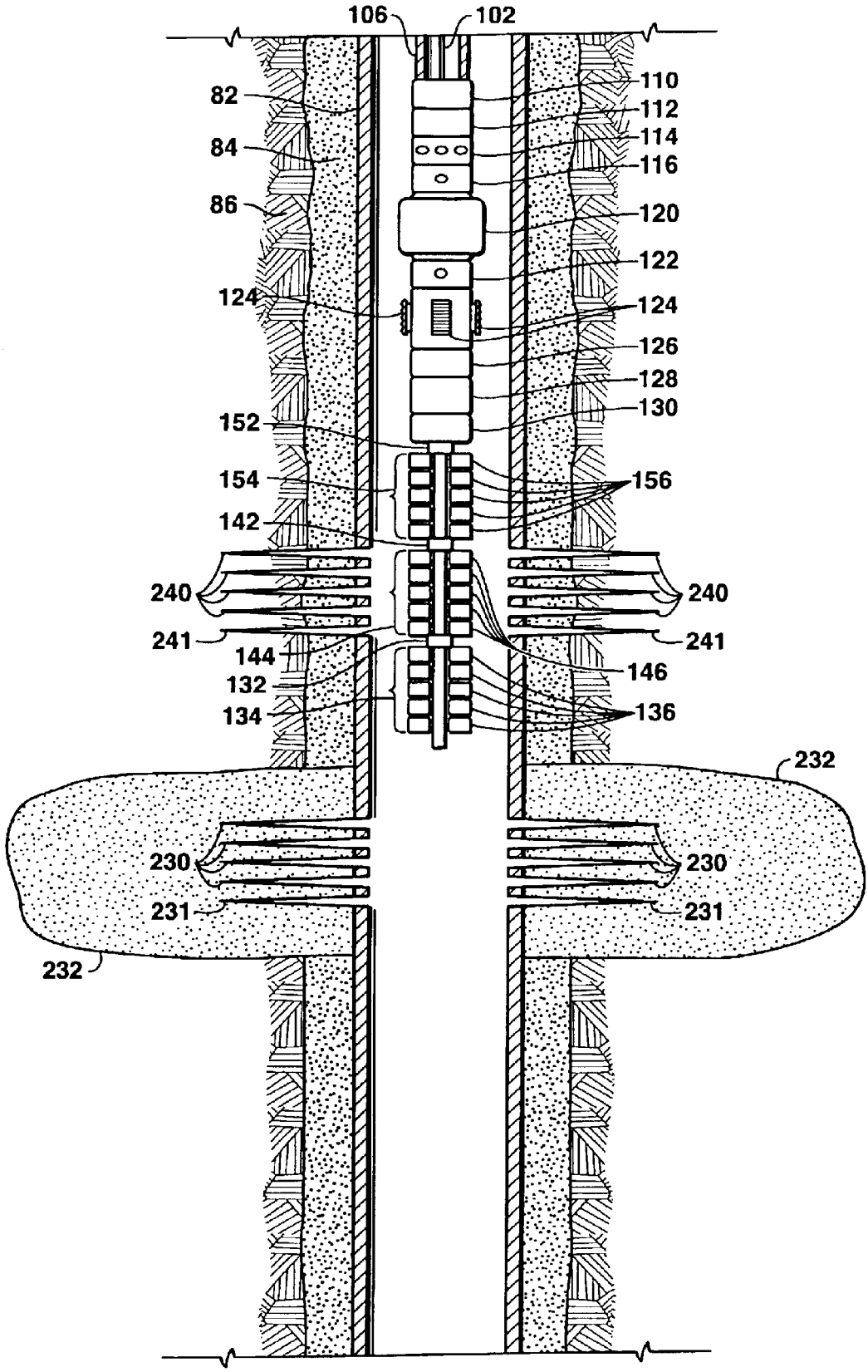
FIG. 3A represents the bottomhole assembly, coiled tubing, and wellbore of FIG. 2C after the bottomhole assembly has been re-positioned and the second set of selectively-fired perforating charges have been fired resulting in perforation holes through the production casing and cement sheath and into the second formation zone such that hydraulic communication is established between the wellbore and the second formation zone.
Figure 3B:
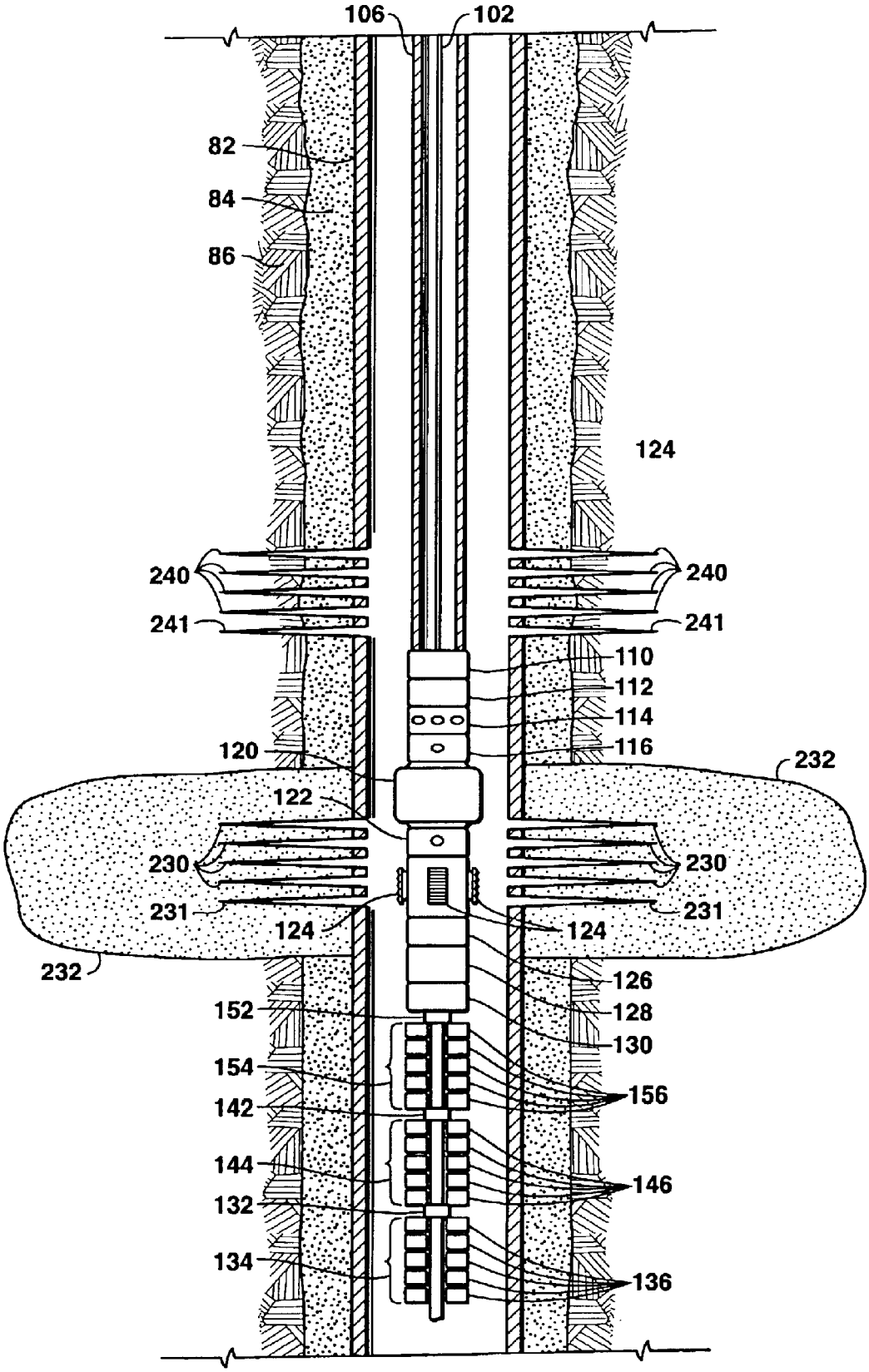
FIG. 3B represents the bottomhole assembly, coiled tubing, and wellbore of FIG. 3A after the bottomhole assembly has been re-positioned a sufficient distance below the deepest perforation of the second perforation set to allow slight movement upward of the BHA to set the re-settable axial slip device while keeping the location of the circulation port below the bottom-most perforation of the second perforation set.
Figure 3C:
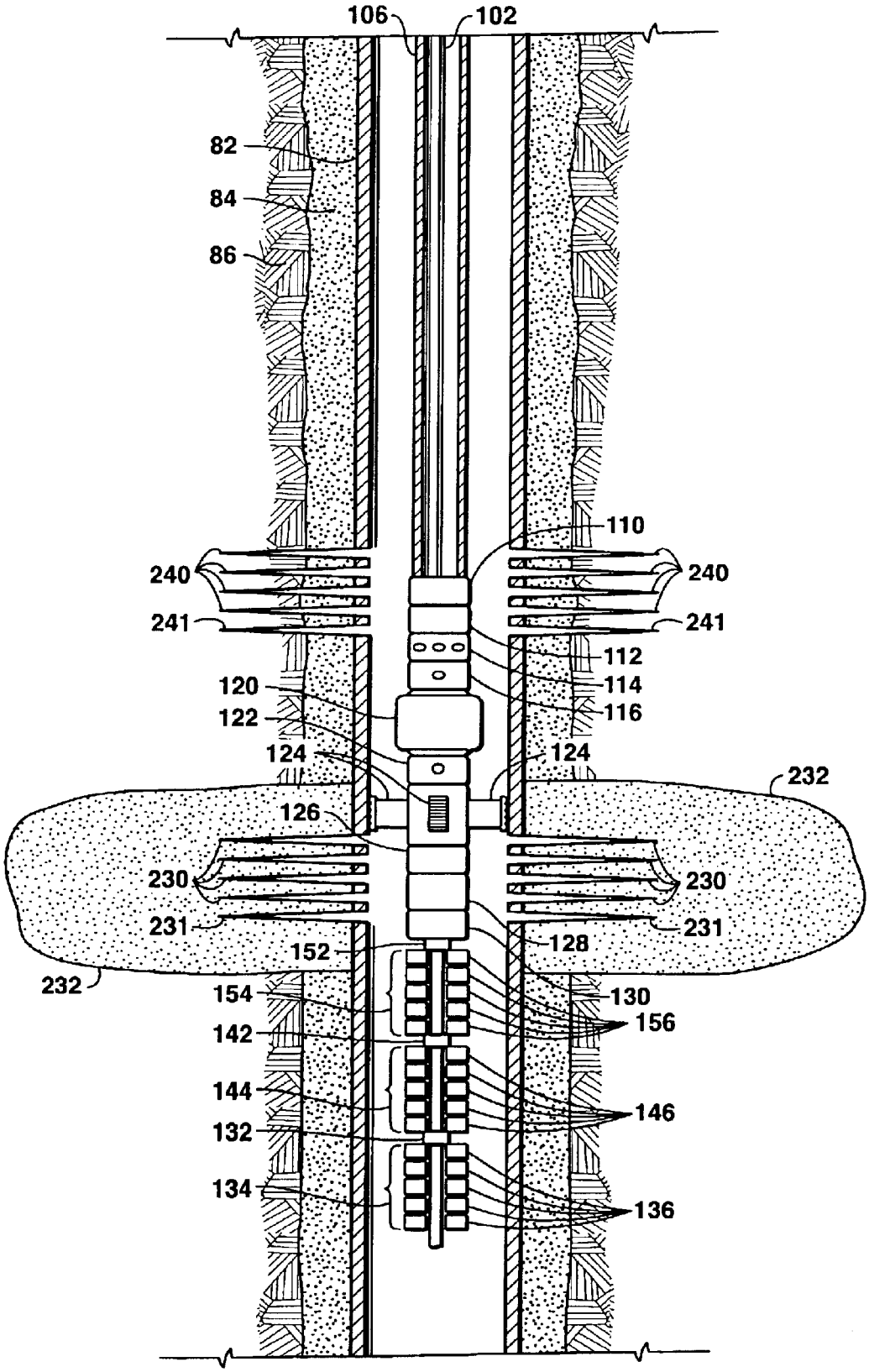
FIG. 3C represents the bottomhole assembly, coiled tubing and wellbore of FIG. 3B after the re-settable mechanical slip device has been actuated to provide resistance to downward axial movement ensuring that the inflatable, re-settable packer and re-settable mechanical slip device are located between the first zone and second zone perforations.
Figure 3D:
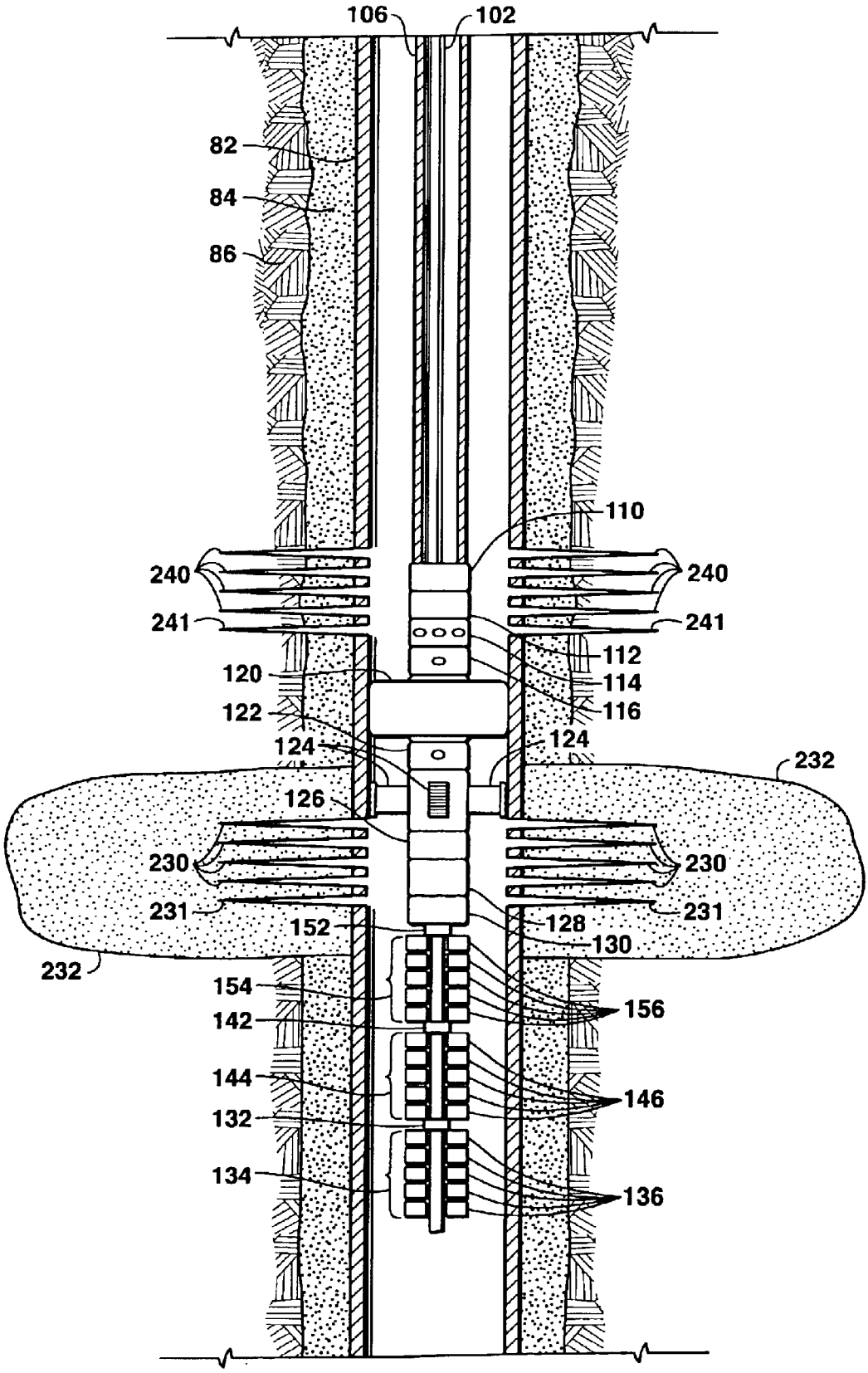
FIG. 3D represents the bottomhole assembly, coiled tubing and wellbore of FIG. 3C after the inflatable, re-settable packer has been actuated to provide a barrier to flow between the portion of the wellbore directly above the inflatable, re-settable packer and the portion of the wellbore directly below the inflatable, re-settable packer.

11. The first stage of the fracture stimulation treatment is initiated by circulating a small volume of fluid down the coiled tubing 106 through the circulation port 114 (via a positive displacement pump). This is followed by initiating the pumping of stimulation fluid down the annulus between the coiled tubing 106 and production casing 82 at fracture stimulation rates. The small volume of fluid flowing down the coiled tubing 106 serves to keep a positive pressure inside the coiled tubing 106 to resist proppant-laden fluid backflow into the coiled tubing 106 and to resist coiled tubing collapse loading during fracturing operations. It is noted that as an alternative means to resist coiled tubing collapse, an internal valve mechanism may be used to maintain the circulation port 114 in the closed position and with positive pressure then applied to the coiled tubing 106 using a surface pump. As an illustrative example of the fracture treatment design for stimulation of a 15-acre size sand lens containing hydrocarbon gas, the first fracture stage could be comprised of "sub-stages" as follows: (a) 5,000 gallons of 2% KCl water; (b) 2,000 gallons of cross-linked gel containing 1 pound-per-gallon of proppant; (c) 3,000 gallons of cross-linked gel containing 2 pounds-per-gallon of proppant; (d) 5,000 gallons of cross-linked gel containing 3 pounds-per-gallon of proppant; and (e) 3,000 gallons of cross-linked gel containing 4 pound-per-gallon of proppant such that 35,000 pounds of proppant are placed into the first zone.
12. As shown in FIG. 2C, all sub-stages of the first fracture operation are completed with the creation of the first proppant fracture 232.
13. At the end of the first stage of the stimulation treatment, should proppant in the wellbore prevent the coiled tubing/BHA from immediate movement; fluid can be circulated through the circulation port 114 to, wash-over and clean-out the proppant to free the coiled tubing/BHA and allow movement.
14. As shown in FIG. 3A, the coiled tubing/BHA is then pulled uphole to slightly above the second deepest target zone such that the second set of perforation charges 146 contained on the select-fire perforating gun system 144 are located slightly above the second deepest target zone where again precise depth control is established based on readings from the casing-collar-locator 128 and coiled tubing odometer systems. The action of moving the BHA upward (to slightly above the second interval to be perforated) will cycle the re-settable mechanical slip "continuous J" mechanism into the pre-lock position. Further cycling of compression/tension loads are performed to place the mechanical slip continuous J mechanism back into the running position. The coiled tubing/BHA is then moved downward to position the perforation charges 146 contained on the select-fire perforating gun system 144 directly across from the second deepest target zone where again precise depth control is established based on readings from the casing-collar-locator 128 and coiled tubing odometer systems.
15. The second set of perforation charges 146 are selectively-fired by remote actuation via the second select-fire head 142 to penetrate the casing 82 and cement sheath 84 and establish hydraulic communication with the formation 86 through the resultant perforations 240–241.
16. As shown in FIG. 3B, the coiled tubing may be moved down the wellbore to position the BHA several feet below the deepest perforation 241 of the second target zone. Subsequent movement of the BHA up the wellbore to position the circulation port 114 directly below the deepest perforation 241 of this second target zone will cycle the re-settable mechanical slips 124 into the pre-lock position, where subsequent downward motion will force the re-settable mechanical slips 124 into the locked position thereby preventing further downward movement.
17. As shown in FIG. 3C, downward movement engages the re-settable mechanical slips 124 with the casing wall 82 thereby preventing further downward movement of the BHA. A compression load on the coiled tubing is then applied and this load closes the circulation port 114 and upper equalization port 116, and creates pressure communication between the inflatable, re-settable packer 120 and the internal coiled tubing pressure. The compression load also locks the circulation port 114 into a position directly below the deepest perforation 241 of this second target zone (to minimize potential for proppant fill above the inflatable, re-settable packer 120 and minimize high velocity proppant flow past the BHA) and with the re-settable, inflatable packer 120 positioned between the first and second perforated intervals.
18. A further compression load is set down on the coiled tubing/BHA to test the re-settable mechanical slips 124 and ensure that additional downward force does not translate into further movement of the BHA down the wellbore.
19. As shown in FIG. 3D, the inflatable, re-settable packer 120 is actuated by pressurizing the coiled tubing 106 to effect a hydraulic seal above and below the inflatable, re-settable packer 120. A compression load is maintained on the BHA to maintain pressure communication between the internal coiled tubing pressure and the inflatable, re-settable packer 120, to keep the circulation port 114 and the upper equalization port 116 closed, and to keep the re-settable mechanical slips 124 in the locked and energized position. The inflatable, re-settable packer 120 is maintained in the actuated state by maintaining pressure in the coiled tubing 106 via a surface pump system (it is noted that alternatively, the inflatable, re-settable packer could be maintained in an actuated state by locking pressure in to the element using an internal valve remotely controlled from surface by a signaling means compatible with other BHA components and other present signaling means).
20. The second stage of the fracture stimulation treatment is initiated with fluid pumped down the annulus between the coiled tubing 106 and production casing 82 at fracture stimulation rates while maintaining compression load on the BHA to keep the circulation port 114 and upper equalization port 116 closed, and maintaining coiled tubing pressure at a sufficient level to resist coiled tubing string collapse and to keep the inflatable, re-settable packer 120 inflated and serve as a hydraulic seal between the annular pressure above the packer before, during and after the fracture operation and the sealed wellbore pressure below the inflatable, re-settable packer.
21. All sub-stages of the fracture operation are pumped leaving a minimal under-flush of the proppant-laden last sub-stage in the wellbore so as not to over-displace the fracture treatment. If during the course of this treatment stage, the seal integrity of the inflatable, re-settable packer 120 is believed to be compromised, the treatment stage could be temporarily suspended to test the packer seal integrity above the highest (shallowest) existing perforations (e.g., perforation 240 in FIG. 3D) after setting the inflatable, re-settable packer 120 in blank pipe. If the seal integrity test were to be performed, it could be desirable to perform a circulation/washing operation to ensure any proppant that may be present in the wellbore is circulated out of the wellbore prior to conducting the test. The circulation/washing operation could be performed by opening the circulation port 114 and then pumping of circulation fluid down the coiled tubing 106 to circulate the proppant out of the wellbore.

Figure 3E:
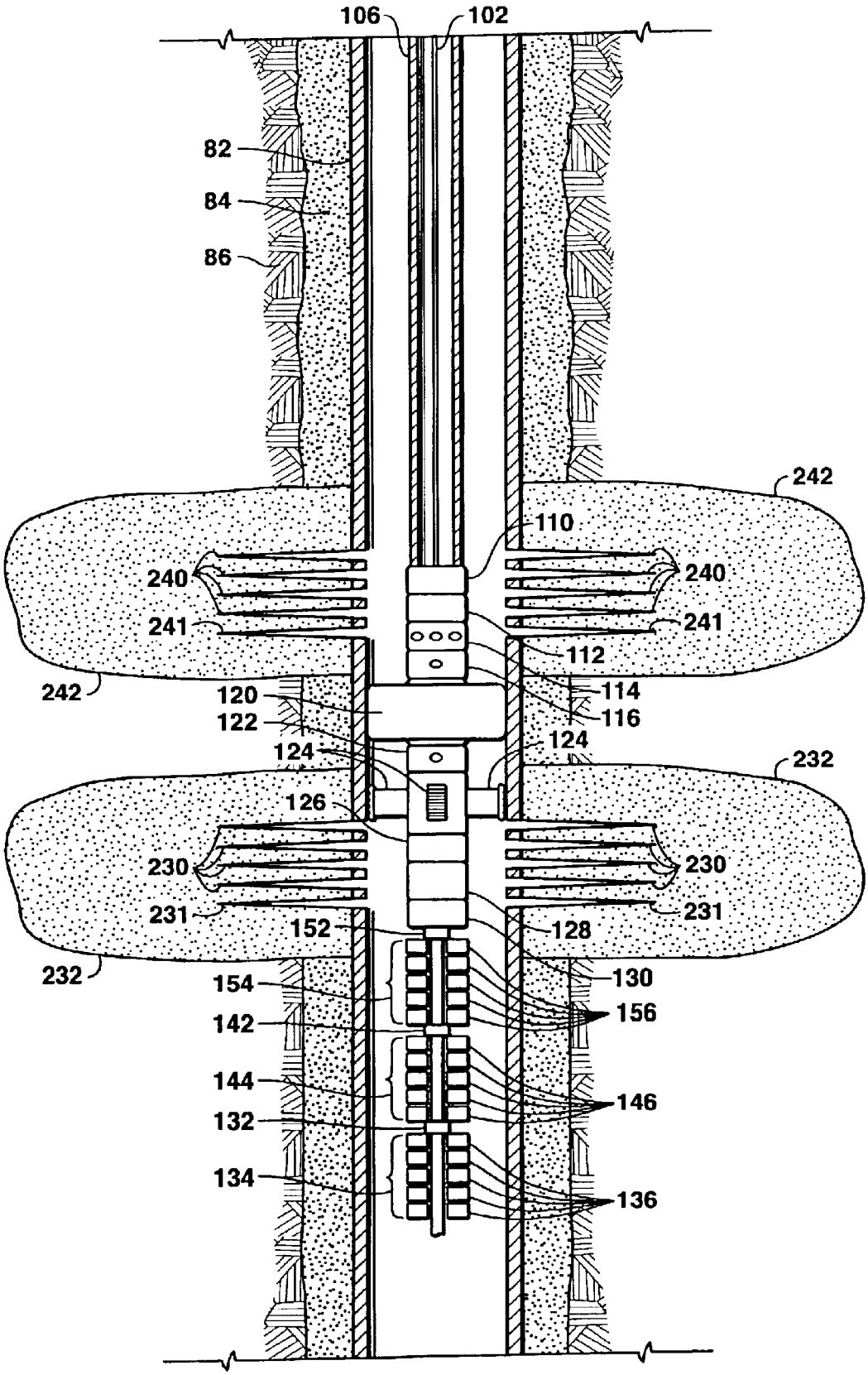
FIG. 3E represents the bottomhole assembly, coiled tubing, and wellbore of FIG. 3D after the second formation zone has been stimulated with the second stage of the multiple stage hydraulic proppant fracture treatment where the second stage of the fracture treatment was pumped downhole in the wellbore annulus existing between the coiled tubing and production casing.

22. As shown in FIG. 3E, all sub-stages of the second fracture operation are completed with the creation of a second proppant fracture 242.

23. After completing the second stage fracture operation and ceasing injection of stimulation fluid down the annulus formed between the coiled tubing 106 and production casing 82, a small tension load is applied to the coiled tubing 106 while maintaining internal coiled tubing pressure. The small applied tension first isolates the inflatable, re-settable packer pressure from the coiled tubing pressure thereby locking pressure in the inflatable, re-settable packer 120 and thereby maintaining a positive pressure seal and imparting significant resistance to axial movement of the inflatable, re-settable packer 120. In the same motion, the applied tension may then open the circulation port 114 and equalization port 116 thereby allowing the coiled tubing pressure to bleed off into the annulus formed by the coiled tubing 106 and production casing 82 while simultaneously allowing the pressure above and below the inflatable, re-settable packer 120 to equilibrate. The surface system pump providing internal coiled tubing pressure may be stopped after equilibrating the downhole pressures.

Figure 3F:
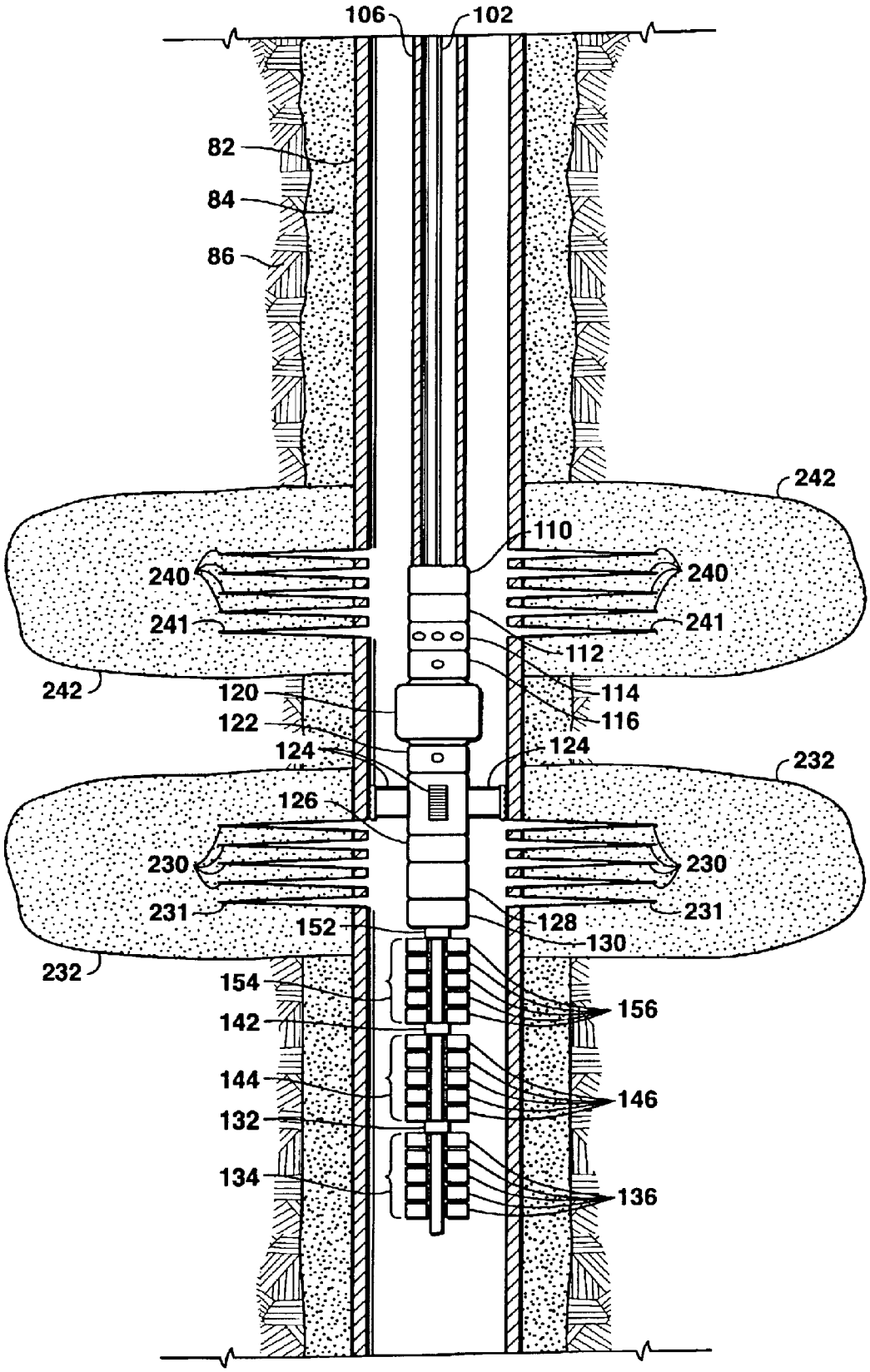
FIG. 3F represents the bottomhole assembly, coiled tubing, and wellbore of FIG. 3E after the inflatable, re-settable packer has been de-activated thereby re-establishing pressure communication between the portion of the wellbore directly above the inflatable, re-settable packer and the portion of the wellbore directly below the inflatable, re-settable packer. The re-settable mechanical slip device is still energized and continues to prevent movement of the coiled tubing and bottomhole assembly down the wellbore.

24. After the pressures inside the coiled tubing, in the annulus formed by the coiled tubing 106 and production casing 82 above the inflatable, re-settable packer 120, and in the annulus formed by the BHA and production casing 82 below the inflatable, re-settable packer 120 equilibrate, a compressive load placed on the coiled tubing will close the circulation port 114 and upper equalization port 116 before releasing the pressure trapped within the inflatable, re-settable packer 120 into the coiled tubing 106. This release of internal pressure from the inflatable, re-settable packer 120 will allow the inflatable, re-settable packer 120 to retract from the production casing wall, as shown in FIG. 3F, in the absence of an external differential pressure across the inflatable, re-settable packer 120 which could otherwise result in forces and movement that could damage the coiled tubing 106 or BHA.

25. Once the inflatable, re-settable packer 120 is unset, as shown in FIG. 3F, tension pulled on the coiled tubing/BHA could de-energize the re-settable mechanical slips 124 thereby allowing the BHA to be free to move and be repositioned up the wellbore.

26. If at the end of the second stage of the stimulation treatment, proppant in the wellbore prevents the coiled tubing/BHA from immediate movement, fluid may be circulated through the circulation port 114 to wash-over and clean-out the proppant to free the coiled tubing/BHA and allow upward movement of the BHA after releasing the inflatable, re-settable packer.

27. The process as described above is repeated until all planned zones are individually-stimulated (FIGS. 3A to 3F represent a BHA designed for a three zone stimulation).

28. Upon completion of the stimulation process, the components of the BHA are returned to running position and the coiled tubing/BHA assembly is removed from the wellbore.

29. If all the desired target zones have been stimulated, the well can be immediately placed on production.

Figure 4A:
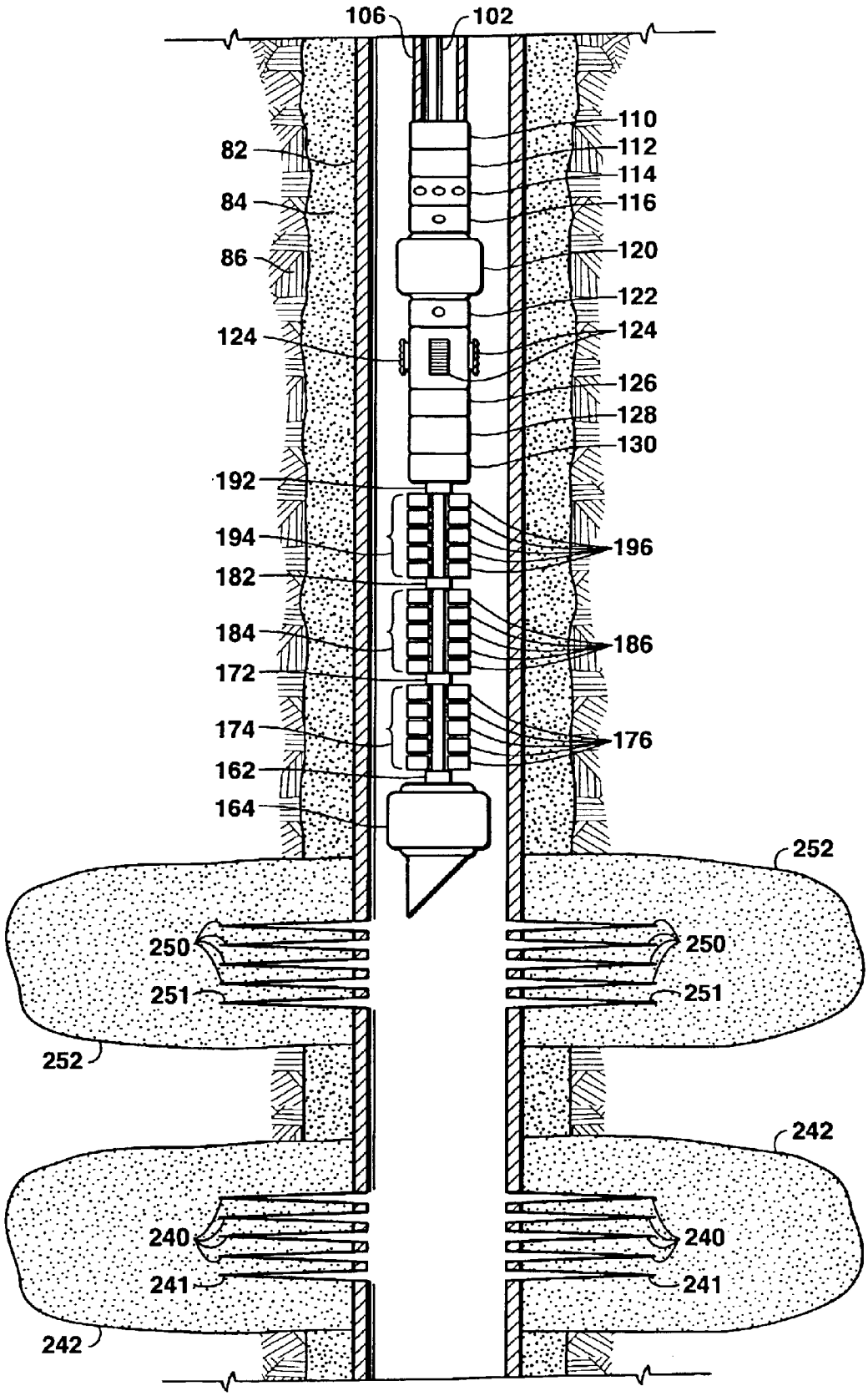
FIG. 4A represents a modified bottomhole assembly, similar to the bottomhole assembly described in FIGS. 2A through 2C and FIGS. 3A through 3F, but with the addition of a mechanical-plug, settable with a select-fire charge setting system, located below the string of perforating guns.

30. If it is desirable to stimulate additional zones, a reel of coiled tubing may be made-up with a slightly modified BHA as shown in FIG. 4A. In this assembly, the only alteration to the BHA of the preferred embodiment described above may be the addition of a select-fire-set mechanical plug 164 or select-fire set bridge-plug 164 located below the lowest select-fire gun assembly as shown in FIG. 4A. In general, the select-fire-set mechanical plug 164 can be either a bridge plug or a fracture baffle. A fracture baffle would generally be preferred if it is desirable to simultaneously produce zones separated by the plug immediately after the stimulation job.

31. The modified BHA, shown in FIG. 4A, consists of a select-fire perforating gun system (FIG. 4A depicts a gun system comprising perforating guns 174, 184 and 194 with associated charges 176, 186 and 196 and select-fire heads 172, 182 and 192), a casing-collar-locator 128, flow ports 114, 116 and 122, an inflatable, re-settable packer 120, a re-settable mechanical axial slip device 124 and select-fire bridge plug 164 set using select-fire head 162. The modified BHA is run into the well via a lubricator and the coiled tubing injection head suspended by crane or rig above the wellhead.

32. The coiled tubing/BHA is run into the well while correlating the depth with the casing collar locator.

33. As shown in FIG. 4A, the coiled tubing/modified BHA is run into the wellbore to position the select-fire mechanical-plug 164 above the last previously stimulated zone 252.

Figure 4B:
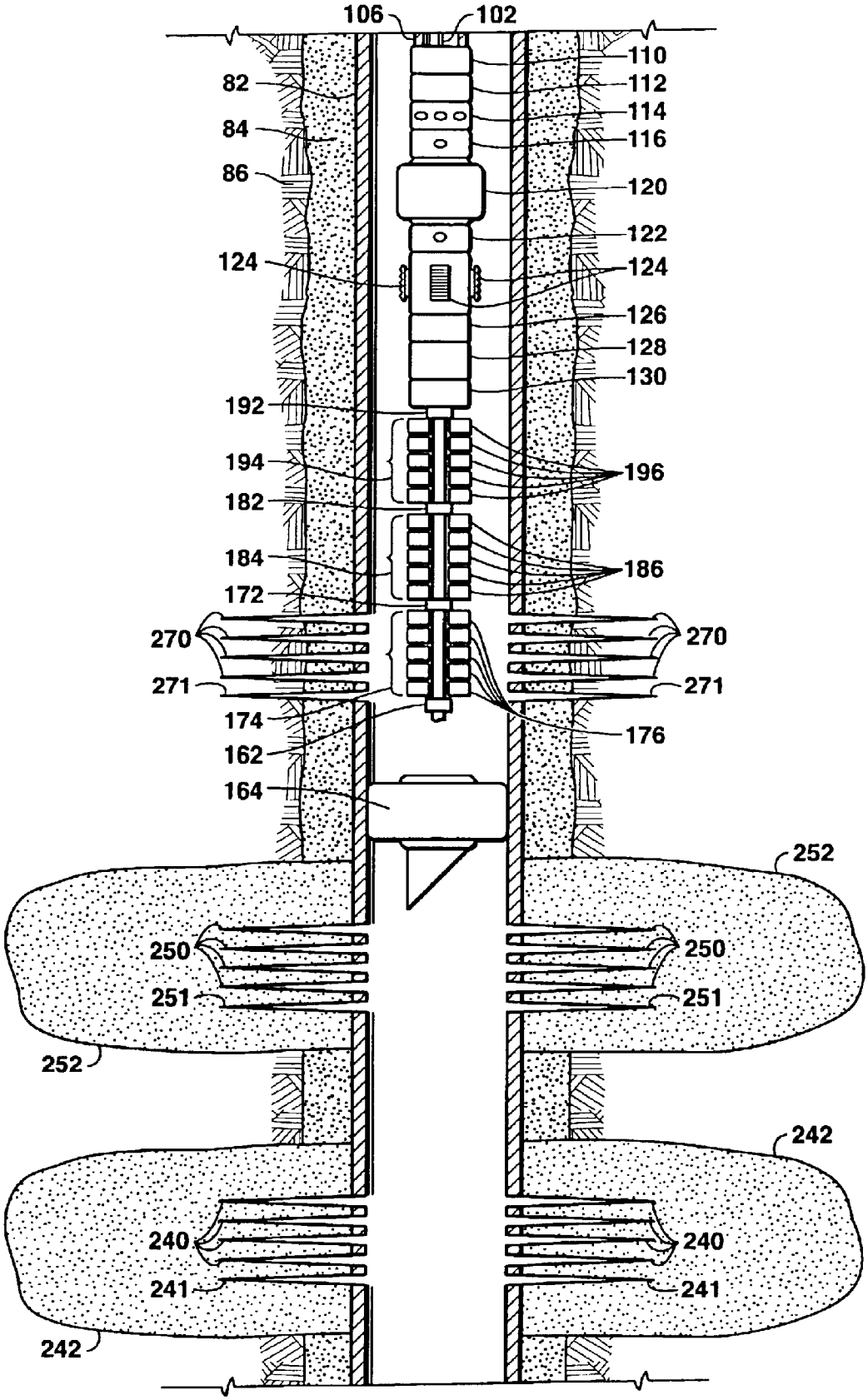
FIG. 4B represents the bottomhole assembly, coiled tubing, and wellbore of FIG. 4A after the mechanical-plug has been select-fire-charge-set in the well and after the bottomhole assembly has been re-positioned and the first set of selectively-fired perforating charges have been fired and result in perforation holes through the production casing and cement sheath and into the fourth formation zone such that hydraulic communication is established between the wellbore and the fourth formation zone.

34. As shown in FIG. 4B the select-fire firing head 162 is fired to set the select-fire mechanical plug 164 above the last previously stimulated zone 252.

35. After the bridge-plug select-fire head 162 is activated to set the select-fire bridge-plug 164, the coiled tubing/modified BHA is then raised to a location within the wellbore such that the first (lowest) set of perforation charges 176 contained on the select-fire perforating gun system are located directly across the next, bottom-most target zone to be perforated where precise depth control may be established based on readings from the casing-collar-locator 128 and coiled tubing odometer systems located on the surface equipment. The action of moving the BHA up to the location of the first perforated interval will cycle the re-settable mechanical slips 124 into the locked position and will require cycling the coiled tubing axial load from compression to tension and back to return the re-settable mechanical slips to running position.

36. As shown in FIG. 4B, the first set of perforation charges 176 on the modified BHA are selectively-fired by remote actuation via the second select-fire head 172 to penetrate the casing 82 and cement sheath 84 with perforations 270, 271 and establish hydraulic communication with the formation 86 through the resultant perforations 270–271.

37. If there is insufficient space between the last previously placed perforations 250, 251 and the location of the next set of perforations 270, 271 to be stimulated to enable appropriate placement of the BHA for perforation, isolation and stimulation of the next set of perforations 270, the select-fire bridge plug 164 may be set below the last previously stimulated perforations 250, 251, and the inflatable, re-settable packer may be employed during the first stimulation operation to isolate the upper-most perforations 270, 271 from the previously stimulated perforations 250, 251.

38. The entire process as described above is then repeated as appropriate until all planned zones are individually-stimulated (FIG. 4A and FIG. 4B represent a BHA designed for an additional three zone stimulation operation).

It will be recognized by those skilled in the art that the preferred suspension method when proppant-laden fluids are involved would be conventional jointed tubing or coiled tubing, preferably with one or more circulation ports so that proppant settling in the wellbore could easily be circulated out of the wellbore. Treatments such as acid fracturing or matrix acidizing may not require such a capability and could readily be performed with a deployment system based on cable such as slickline or wireline, or based on a downhole tractor system.

It will be recognized by those skilled in the art that depending on the objectives of a particular job, various pumping systems could be used and could involve the following arrangements: (a) pumping down the annulus created between the cable or tubing (if the deployment method uses cable or tubing) and the casing wall; (b) pumping down the interior of the coiled tubing or jointed tubing if the suspension method involves the use of coiled tubing or jointed tubing and excess friction and proppant erosion were not of concern for the well depths considered; or (c) simultaneously pumping down the annulus created between the tubing (if the deployment method involves tubing) and the casing wall and the interior of the tubing if excess friction and proppant erosion were not of concern for the well depths considered.

Figure 5:
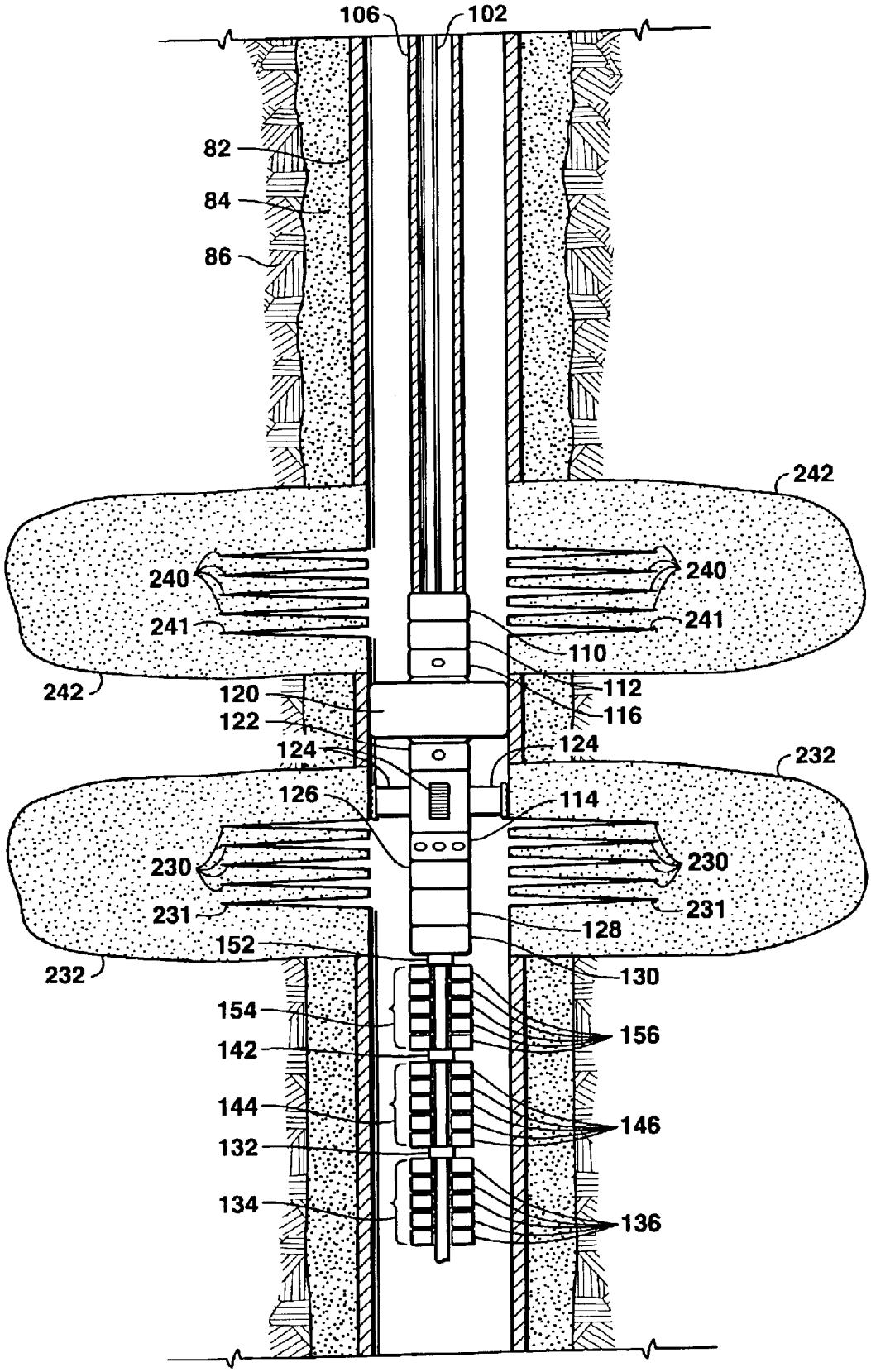
FIG. 5 represents a second embodiment of the invention. In this embodiment, the suspension means is a tubing string, and once an interval has been perforated, the BHA can be moved and the sealing mechanism actuated to establish a hydraulic seal above the perforated interval. Then treating fluid can be pumped down the tubing string and into the perforated interval.

FIG. 5 illustrates a second embodiment of the invention where coiled tubing is used as the deployment means and excess friction is not of concern and either proppant is not pumped during the job or use of proppant is not of concern. FIG. 5 shows that coiled tubing 106 is used to suspend the BHA and BHA components. In this embodiment, the individual zones are treated in sequential order from shallower wellbore locations to deeper wellbore locations. In this embodiment, as shown in FIG. 5, circulation port 114 is now placed below the inflatable, re-settable packer 120 such that treatment fluid may be pumped down the interior of coiled tubing 106, exit the circulation port 114, and be positively forced to enter the targeted perforations. As an illustration of the operations, FIG. 5 shows that the inflatable, re-settable packer 120 has been actuated and set below perforations 241 that are associated with a previous zone hydraulic fracture 242. The inflatable, re-settable packer 120 provides hydraulic isolation such that when treatment fluid is subsequently pumped down the coiled tubing 106, the treating fluid is forced to enter previously placed perforations 230 and 231 and create new hydraulic fractures 232. The operations are then continued and repeated as appropriate for the desired number of formation zones and intervals.

Figure 6:
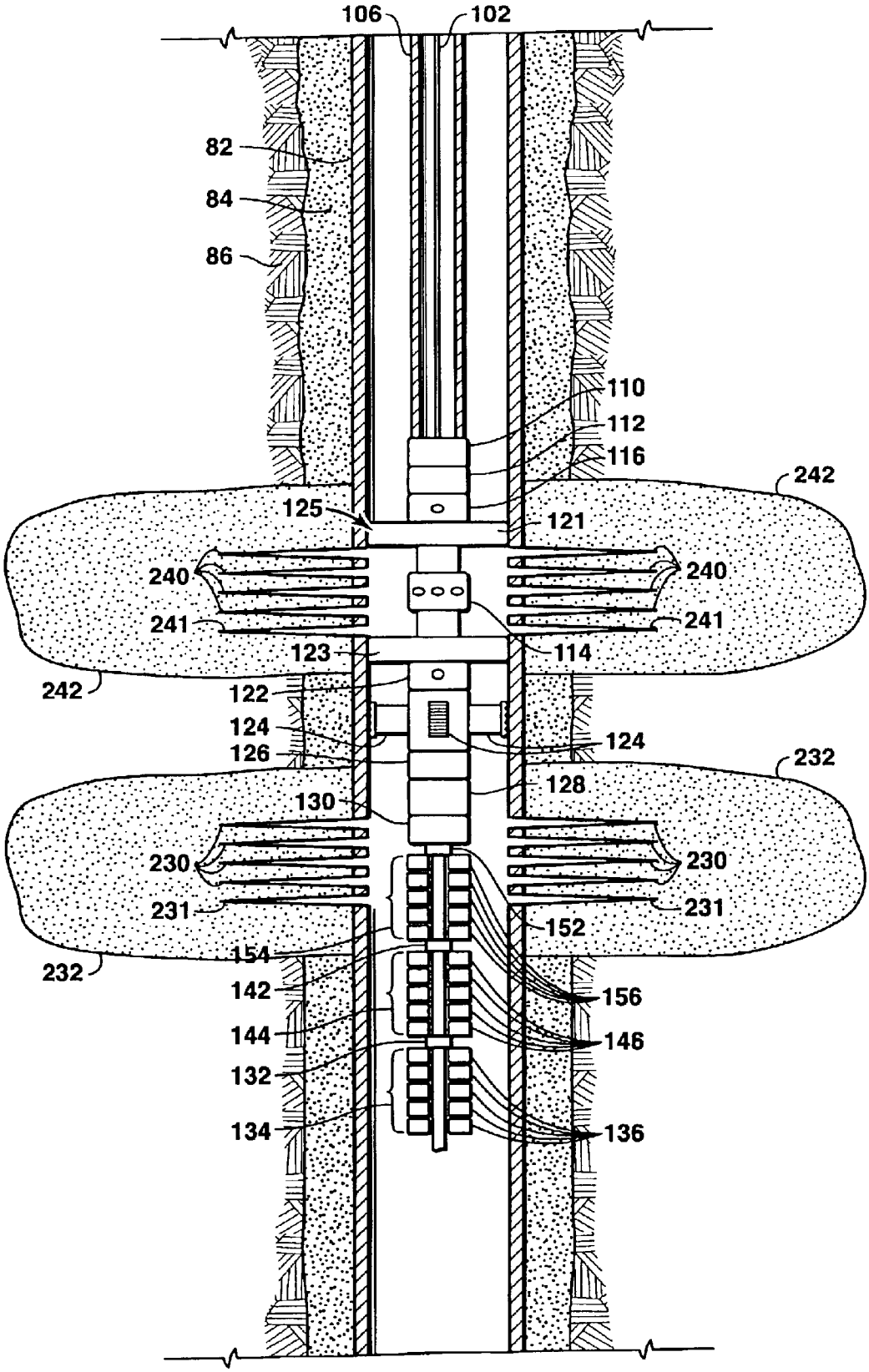
FIG. 6 represents a third embodiment of the invention. The suspension means is a tubing string, and the BHA can be moved and the sealing mechanism actuated to establish a hydraulic seal above and below the perforated interval (where the sealing mechanism consists of two seal elements spaced sufficient distance apart to straddle the perforated interval). In this third embodiment, treating fluid can be pumped down the tubing string itself, through a flow port placed in-between the two seal elements of the sealing mechanism and into the perforated interval.

FIG. 6 illustrates a third embodiment of the invention where coiled tubing is used as the deployment means and excess friction is not of concern and either proppant is not pumped during the job or use of proppant is not of concern. FIG. 6 shows that coiled tubing 106 is used to suspend the BHA and BHA components. In this embodiment, the individual zones may be treated in any order. In this embodiment, as shown in FIG. 6, a straddle-packer inflatable sealing mechanism 125 is used as the re-settable sealing mechanism and the circulation port 114 is now placed between the upper inflatable sealing element 121 and the lower inflatable sealing element 123. When the upper inflatable sealing element 121 and the lower inflatable sealing element 123 are actuated, treatment fluid may be pumped down the interior of coiled tubing 106 to exit the circulation port 114, and then be positively forced to enter the targeted perforations. As an illustration of the operations, FIG. 6 shows that the upper inflatable sealing element 121 and the lower inflatable sealing element 123 have been actuated and set across perforations 241 that are associated with the next zone to be fractured. The inflatable, re-settable packer 120 provides hydraulic isolation such that when treatment fluid is subsequently pumped down the coiled tubing 106, the treating fluid is forced to enter previously placed perforations 240 and 241 and create new hydraulic fractures 242. The operations are then continued and repeated as appropriate for the desired number of formation zones and intervals.

Figure 7:
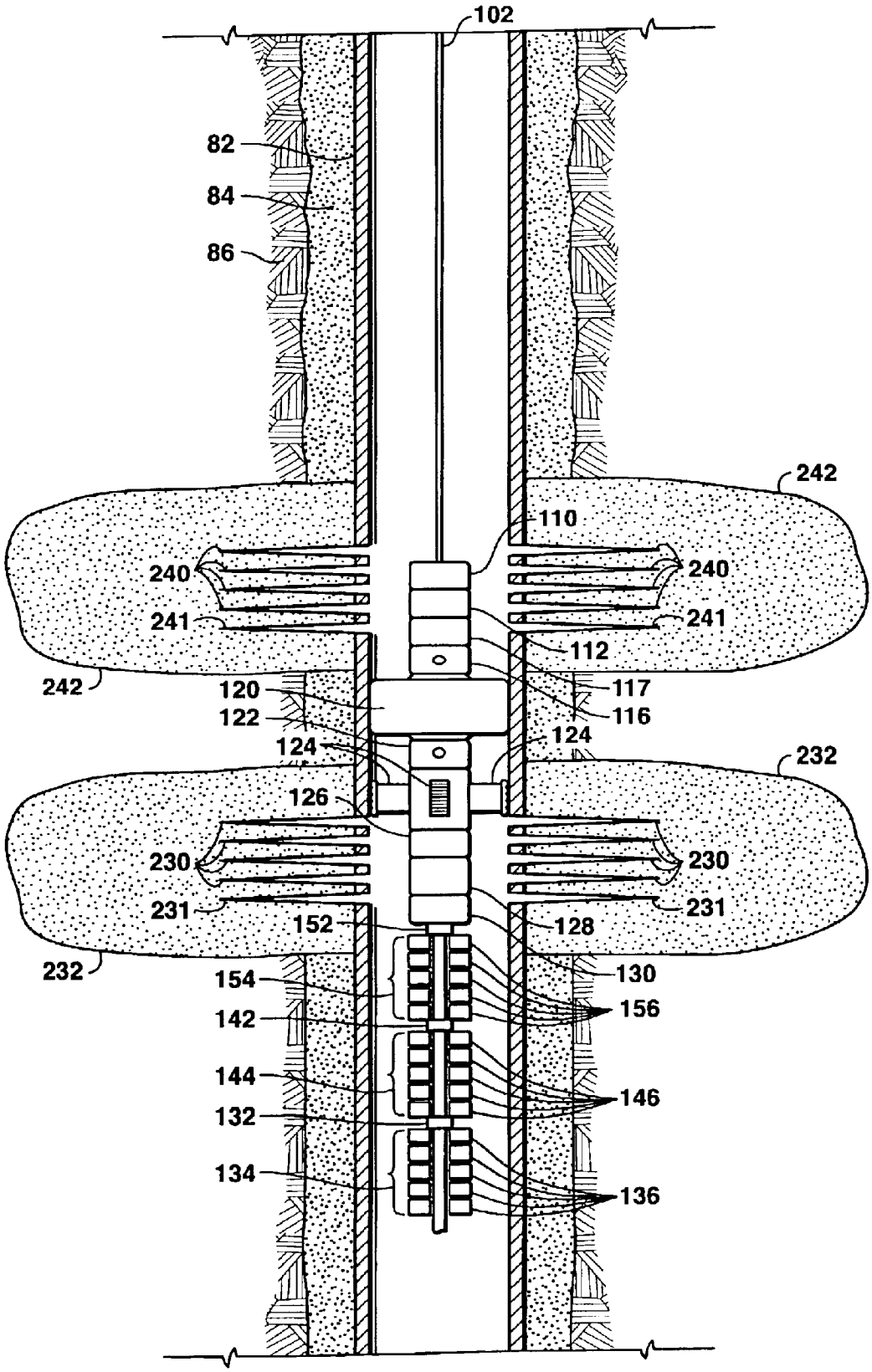
FIG. 7 represents a fourth embodiment of the invention. The BHA is suspended in the wellbore using a wireline (or slickline or cable). The BHA would be moved and the sealing mechanism actuated to establish a hydraulic seal below the perforated interval to be treated, and the treating fluid would be pumped down the annulus between the wireline, slickline, or cable, and the wellbore.

FIG. 7 illustrates a fourth embodiment of the invention where a wireline 102 is used as the deployment means to suspend the BHA and BHA components. In this embodiment, the individual zones are treated in sequential order from deeper wellbore locations to shallower wellbore locations. In this embodiment, as shown in FIG. 7, treatment fluid may be pumped down the annulus between the wireline 102 and production casing wall 82 and be positively forced to enter the targeted perforations. In this embodiment, the inflatable re-settable packer 120 also contains an internal electrical pump system 117, powered by electrical energy transmitted downhole via the wireline, to inflate or deflate the inflatable, re-settable packer 120 using wellbore fluid. FIG. 7 shows that the inflatable, re-settable packer 120 has been actuated and set below the perforations 241 that are associated with the next zone to be fractured. The inflatable, re-settable packer 120 provides hydraulic isolation such that when treatment fluid is subsequently pumped down the annulus between the wireline 102 and production casing 82, the treating fluid is forced to enter perforations 240 and 241 and create new hydraulic fractures 242. The operations are then continued and repeated as appropriate for the desired number of formation zones and intervals.

Figure 8A:
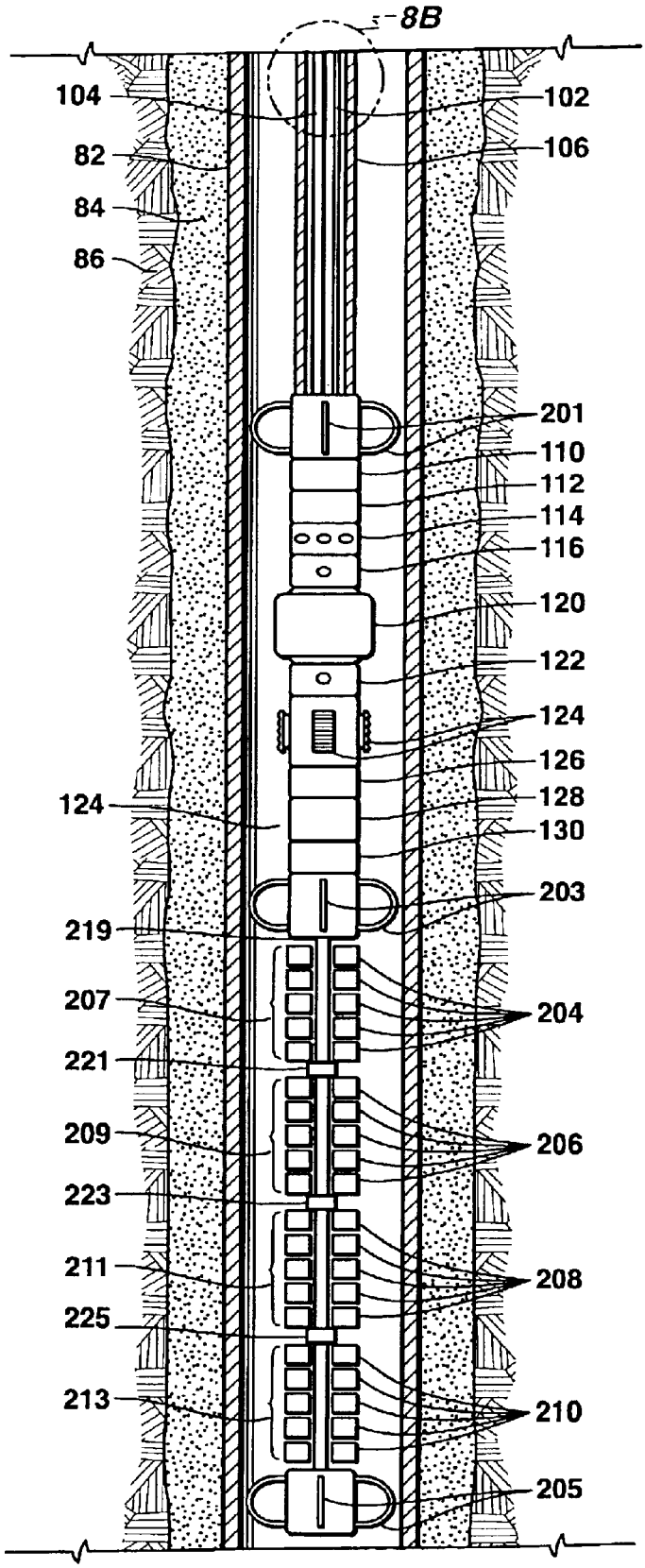
FIGS. 8A and 8B represent a fifth embodiment of the invention that utilizes an umbilical tubing, deployed interior to the tubing used as the deployment means, for actuation of the re-settable sealing mechanism.
Figure 8B:
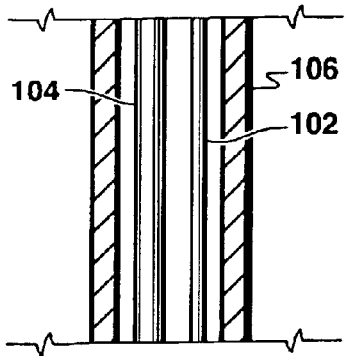

A fifth embodiment of the invention involves deployment of additional tubing strings or cables, hereinafter referred to as "umbilicals", interior and/or exterior to coiled tubing (or jointed tubing). As shown in FIG. 8A and FIG. 8B, a tubing umbilical 104 is shown deployed in the interior of the coiled tubing 106. In this embodiment, the tubing umbilical 104 is connected to the re-settable sealing mechanism 120 and in this embodiment the re-settable sealing mechanism 120 is now actuated via hydraulic pressure transmitted via the umbilical 104. In general, multiple umbilicals can be deployed either in the interior of the coiled tubing and/or in the annulus between the coiled tubing and production casing. In general, the umbilicals can be used to perform several different operations, including but not limited to, providing (a) hydraulic communication for actuation of individual BHA components including, but not limited to, the sealing mechanism and/or perforating device; (b) flow conduits for downhole injection or circulation of additional fluids; and (c) for data acquisition from downhole measurement devices. It is noted that as shown in FIG. 8A, the BHA also includes centralizers 201, 203, and 205 that are used to keep the BHA centralized in the wellbore when BHA components are in the running position.

The use of an umbilical(s) can provide the ability to hydraulically engage and/or disengage the re-settable mechanical sealing mechanism independent of the hydraulic pressure condition within the coiled tubing. This then allows the method to be extended to use of re-settable mechanical sealing mechanisms requiring independent hydraulic actuation for operation. Perforating devices that require hydraulic pressure for selective-firing can be actuated via an umbilical. This may then allow the wireline, if deployed with the coiled tubing and BHA, to be used for transmission of an additional channel or channels of electrical signals, as may be desirable for acquisition of data from measurement gauges located on the bottomhole assembly; or actuation of other BHA components, for example, an electrical downhole motor-drive that could provide rotation/torque for BHA components. Alternatively, an umbilical could be used to operate a hydraulic motor for actuation of various downhole components (e.g., a hydraulic motor to engage or disengage the re-settable sealing mechanism).

The use of an umbilical(s) can provide the ability to inject or circulate any fluid downhole to multiple locations as desired with precise control. For example, to help mitigate proppant settling on the sealing mechanism during a hydraulic proppant fracture treatment, umbilical(s) could be deployed and used to provide independent continuous or intermittent washing and circulation to keep proppant from accumulating on the sealing mechanism. For example, one umbilical could run to just above the re-settable mechanical sealing mechanism while another is run just below the re-settable mechanical sealing mechanism. Then, as desired, fluid (e.g., nitrogen) could be circulated downhole to either or both locations to wash the proppant from the region surrounding the sealing mechanism and hence mitigate the potential for the BHA sticking due to proppant accumulation. In the case of fluid circulation, it is noted that the umbilical size and fluid would be selected to ensure the desired rate is achieved and is not unduly limited by friction pressure in the umbilical.

In addition to umbilicals comprised of tubing strings that provide hydraulic communication downhole as a signaling means for actuation of BHA components (or possibly as a signal transmission means for surface recording of downhole gauges), in general, one or more wireline or fiber-optic cables could be deployed in the wellbore to provide a electrical or electro-optical communication downhole as a signaling means for actuation of BHA components (or possibly as a signal transmission means for surface recording of downhole gauges).

Figure 9:
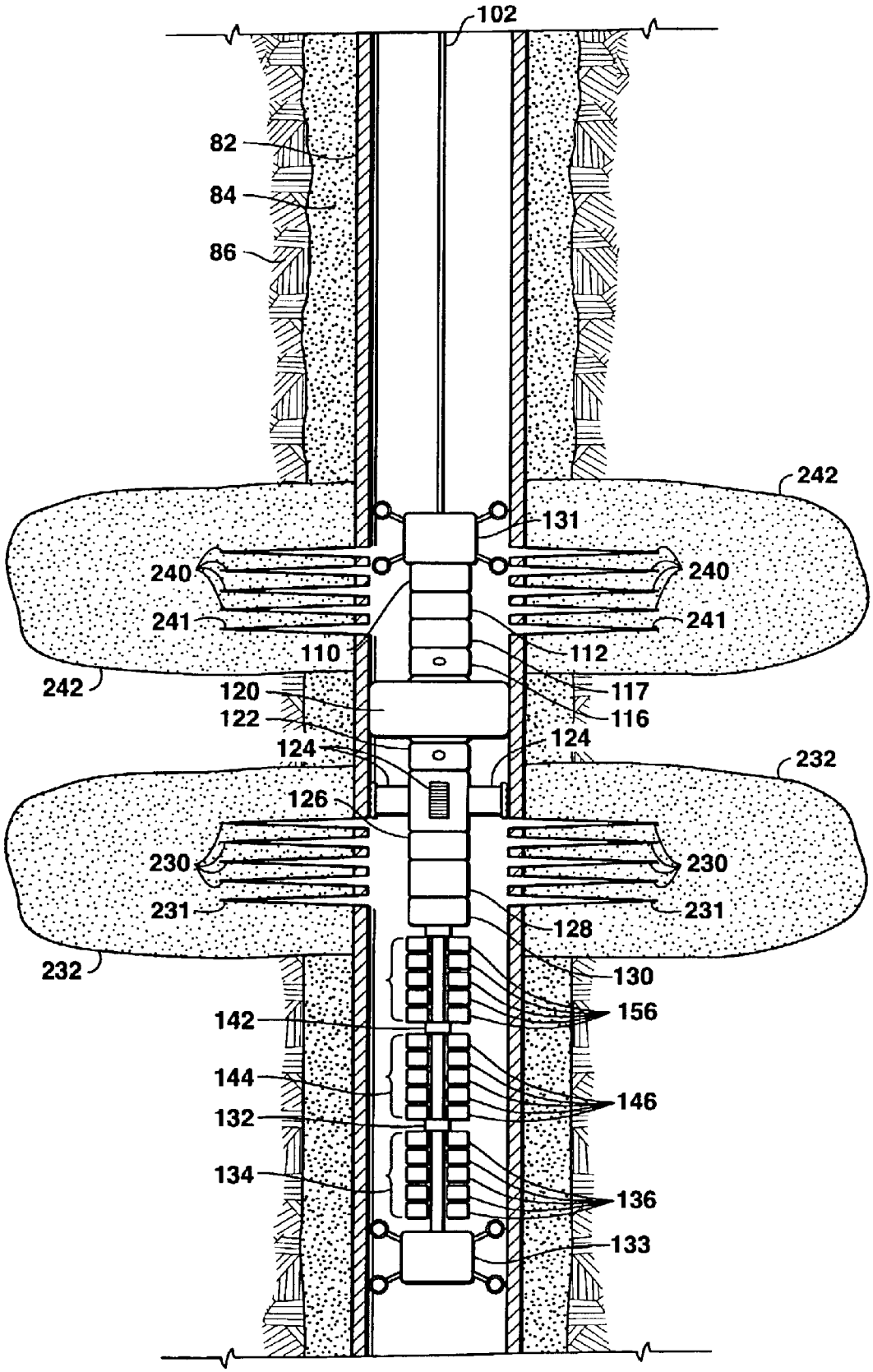
FIG. 9 represents a sixth embodiment of the invention that utilizes a tractor system attached to the BHA such that BHA can be moved and the sealing mechanism actuated to establish a hydraulic seal below the perforated interval. The treating fluid can be pumped down the wellbore and into the perforated interval.

FIG. 9 illustrates a sixth embodiment of the invention where a tractor system, comprised of upper tractor drive unit 131 and lower tractor drive unit 133, is attached to the BHA and is used to deploy and position the BHA within the wellbore. In this embodiment, the individual zones are treated in sequential order from deeper wellbore locations to shallower wellbore locations. In this embodiment, the BHA also contains an internal electrical pump system 117, powered by electrical energy transmitted downhole via the wireline 102, to inflate or deflate the inflatable, re-settable packer 120 using wellbore fluid. In this embodiment, treatment fluid is pumped down the annulus between the wireline 102 and production casing wall 82 and is positively forced to enter the targeted perforations. FIG. 9 shows that the inflatable, re-settable packer 120 has been actuated and set below the perforations 241 that are associated with the next zone to be fractured. The inflatable, re-settable packer 120 provides hydraulic isolation such that when treatment fluid is subsequently pumped down the annulus between the wireline 102 and production casing 82, the treating fluid is forced to enter perforations 240 and 241 and create new hydraulic fractures 242. The operations are then continued and repeated as appropriate for the desired number of formation zones and intervals.

As alternatives to this sixth embodiment, the tractor system could be self-propelled, controlled by on-board computer systems, and carry on-board signaling systems such that it would not be necessary to attach cable or tubing for positioning, control, and/or actuation of the tractor system. Furthermore, the various BHA components could also be controlled by on-board computer systems, and carry on-board signaling systems such that it is not necessary to attach cable or tubing for control and/or actuation of the components. For example, the tractor system and/or BHA components could carry on-board power sources (e.g., batteries), computer systems, and data transmission/reception systems such that the tractor and BHA components could either be remotely controlled from the surface by remote signaling means, or alternatively, the various on-board computer systems could be pre-programmed at the surface to execute the desired sequence of operations when the deployed in the wellbore.

In a seventh embodiment of this invention, abrasive (or erosive) fluid jets are used as the means for perforating the wellbore. Abrasive (or erosive) fluid jetting is a common method used in the oil industry to cut and perforate downhole tubing strings and other wellbore and wellhead components. The use of coiled tubing or jointed tubing as the BHA suspension means provides a flow conduit for deployment of abrasive fluid-jet cutting technology. To accommodate this, the BHA is configured with a jetting tool. This jetting tool allows high-pressure high-velocity abrasive (or erosive) fluid systems or slurries to be pumped downhole through the tubing and through jet nozzles. The abrasive (or erosive) fluid cuts through the production casing wall, cement sheath, and penetrates the formation to provide flow path communication to the formation. Arbitrary distributions of holes and slots can be placed using this jetting tool throughout the completion interval during the stimulation job. In general, abrasive (or erosive) fluid cutting and perforating can be readily performed under a wide range of pumping conditions, using a wide-range of fluid systems (water, gels, oils, and combination liquid/gas fluid systems) and with a variety of abrasive solid materials (sand, ceramic materials, etc.), if use of abrasive solid material is required for the wellbore specific perforating application.

The jetting tool replaces the conventional select-fire perforating gun system described in the previous six embodiments, and since this jetting tool can be on the order of one-foot to four-feet in length, the height requirement for the surface lubricator system is greatly reduced (by possible up to 60-feet or greater) when compared to the height required when using conventional select-fire perforating gun assemblies as the perforating device. Reducing the height requirement for the surface lubricator system provides several benefits including cost reductions and operational time reductions.

Figure 10:
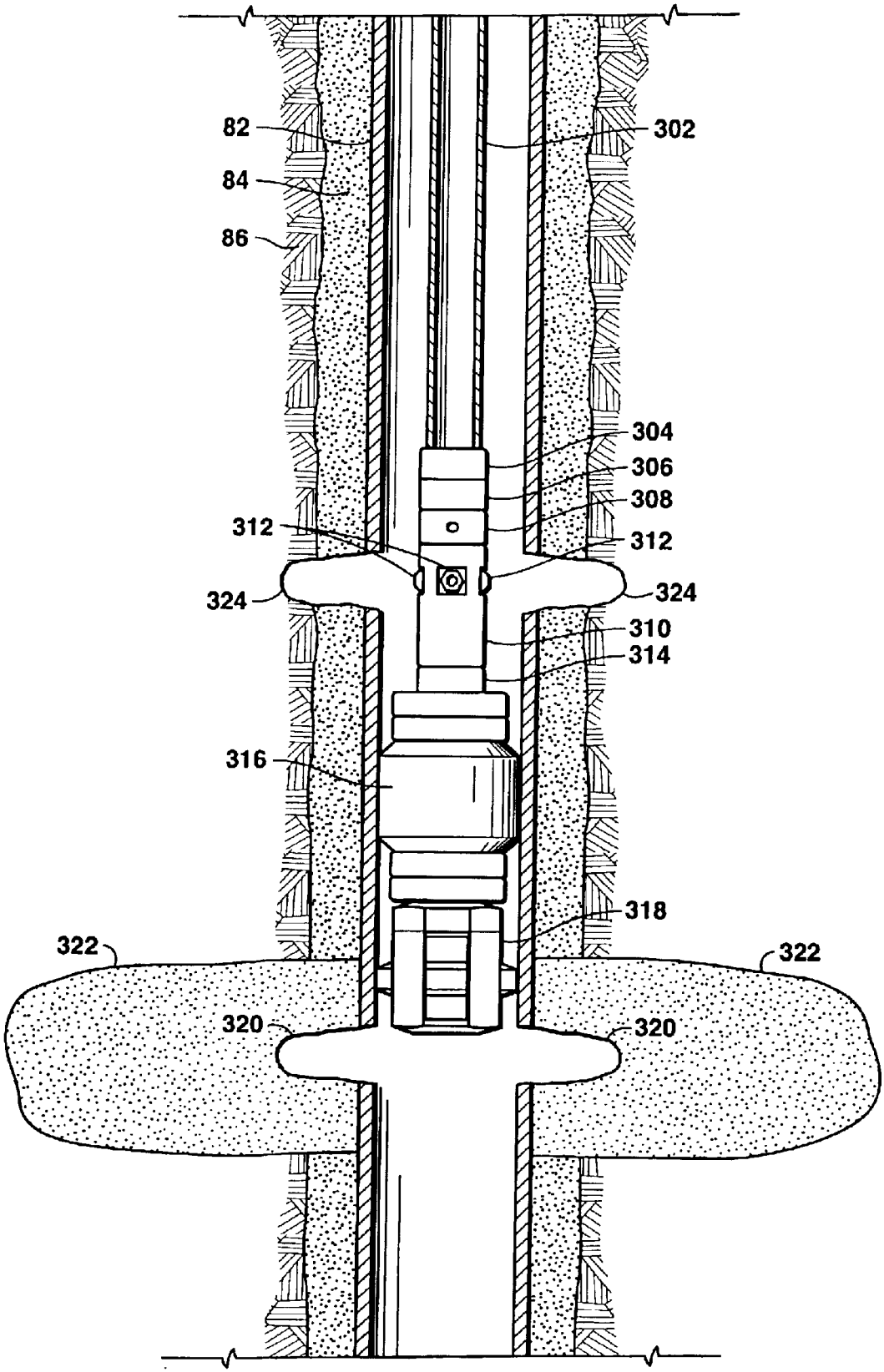
FIG. 10 represents a seventh embodiment of the invention that utilizes abrasive or erosive fluid-jet cutting technology for the perforating device. The BHA is suspended in the wellbore using jointed tubing and consists of a mechanical compression-set, re-settable packer, an abrasive or erosive fluid jet perforating device, a mechanical casing-collar locator, and ancillary components. In this embodiment, perforations are created by pumping an abrasive fluid down the jointed tubing and out of a jetting tool located on the BHA such that a high-pressure high-speed abrasive or erosive fluid jet is created and used to penetrate the production casing and surrounding cement sheath to establish hydraulic communication with the desired formation interval. After setting the re-settable packer below the zone to be stimulated, the stimulation treatment can then pumped down the annulus located between the tubing string and the production casing string.

FIG. 10 illustrates in detail a seventh embodiment of the invention where a jetting tool 310 is used as the perforating device and jointed tubing 302 is used to suspend the BHA in the wellbore. In this embodiment, a mechanical compression-set, re-settable packer 316 is used as the re-settable sealing device; a mechanical casing-collar-locator 318 is used for BHA depth control and positioning; a one-way full-opening flapper-type check valve sub 304 is used to ensure fluid will not flow up the jointed tubing 302; a combination shear-release fishing-neck sub 306 is used as a safety release device; a circulation/equalization port sub 308 is used to provide a method for fluid circulation and also pressure equalization above and below the mechanical compression-set, re-settable packer 316 under certain circumstances; and a one-way ball-seat check valve sub 314 is used to ensure that fluid may only flow upward from below the mechanical compression-set, re-settable packer 316 to the circulation/equalization port sub 308.

The jetting tool 310 contains jet flow ports 312 that are used to accelerate and direct the abrasive fluid pumped down jointed tubing 302 to jet with direct impingement on the production casing 82. In this configuration, the mechanical casing collar locator 318 is appropriately designed and connected to the mechanical compression-set, re-settable packer 316 such as to allow for fluid flow upward from below mechanical compression-set, re-settable packer 316 to the circulation/equalization port sub 308. The cross-sectional flow area associated with the flow conduits contained within the circulation/equalization port sub 308 are sized to provide a substantially larger cross-sectional flow area than the flow area associated with the jet flow ports 312 such that the majority of flow within the jointed tubing 302 or BHA preferentially flows through the circulation/equalization port sub 308 rather than the jet flow ports 312 when the circulation/equalization port sub 308 is in the open position. The circulation/equalization port sub 308 is opened and closed by upward and downward axial movement of jointed pipe 302.

In this embodiment, jointed tubing 302 is preferably used with the mechanical compression-set, re-settable packer 316 since the mechanical compression-set, re-settable packer 316 can be readily actuated and de-actuated by vertical movement and/or rotation applied via the jointed tubing 302. Vertical movement and/or rotation is applied via the jointed tubing 302 using a completion rig-assisted snubbing unit with the aid of a power swivel unit as the surface means for connection, installation, and removal of the jointed tubing 302 in to and out of the wellbore. It is noted that the surface hardware, methods, and procedures associated with use of a completion rig-assisted snubbing unit with a power swivel unit are common and well-known to those skilled in the art for connection, installation, and removal of jointed tubing in/from a wellbore under pressure. Alternatively, use of a completion rig with the aid of a power swivel unit, and stripping head in place of the snubbing unit, could accommodate connection, installation, and removal of the jointed tubing in/from a wellbore under pressure; again this is common and well-known to those skilled in the art for connection, installation, and removal of jointed tubing in/from a wellbore under pressure. It is further noted that the surface rig-up and plumbing configuration will include appropriate manifolds, piping, and valves to accommodate flow to, from, and between all appropriate surface components/facilities and the wellbore, including but not limited to, the jointed tubing, annulus between jointed tubing and production casing, pumps, fluid tanks, and flow-back pits.

Since the mechanical compression-set, re-settable packer is actuated via jointed tubing 302 vertical movement and/or rotation, fluid can be pumped down the jointed tubing 302 without the necessity of additional control valves and/or isolation valves that may otherwise be required if an inflatable packer was used as the re-settable sealing device. The interior of the jointed tubing 302 is used in this fashion to provide an independent flow conduit between the surface and the jetting tool 310 such that abrasive fluid can be pumped down the jointed tubing 302 to the jetting tool 310. The jet flow ports 312 located on the jetting tool 310 then create a high velocity abrasive fluid jet that is directed to perforate the production casing 82 and cement sheath 84 to establish hydraulic communication with the formation 86.

FIG. 10 shows the jetting tool 310 has been used to place perforations 320 to penetrate the first formation interval of interest, and that the first formation interval of interest has been stimulated with hydraulic fractures 322. FIG. 10 further shows the jetting tool 310 has been repositioned within the wellbore and used to place perforations 324 in the second formation interval of interest, and that the mechanical compression-set, re-settable packer 316 has been actuated to provide a hydraulic seal within the wellbore in advance of stimulating perforations 324 with the second stage of the multi-stage hydraulic proppant fracture treatment.

It is noted that the jet flow ports 312 may be located within approximately six-inches to one-foot of the mechanical compression-set, re-settable packer 316 such that after pumping the second proppant fracture stage, should proppant accumulation on the top of the mechanical compression-set, re-settable packer 316 be of concern, non-abrasive and non-erosive fluid can be pumped down the jointed tubing 302 and through the jet flow ports 312 and/or the circulation/equalization port sub 308 as necessary to clean proppant from the top of the mechanical compression-set, re-settable packer 316. Furthermore, the jetting tool 310 may be rotated (when the mechanical compression-set, re-settable packer 316 is not actuated) using the jointed tubing 302 which may be rotated with the surface power swivel unit to further help to clean proppant accumulation that may occur above the mechanical compression-set, re-settable packer 316. Since the perforations are created using a fluid jet, perforation burrs will not be created. Since perforation burrs are not present to potentially provide additional wear and tear on the elastomers of the mechanical compression-set re-settable packer 316, the longevity of the mechanical compression-set re-settable packer 316 may be increased when compared to applications where perforation burrs may exist.

It is further noted that the flow control provided by the one-way ball-seat check valve sub 314 and the one-way full-opening flapper-type check valve sub 304 only allows for pressure equalization above and below the mechanical compression-set, re-settable packer 316 when the pressure below the mechanical compression-set, re-settable packer 316 is larger than the pressure above the mechanical compression-set, re-settable packer 316. In circumstances when the pressure above the mechanical compression-set, re-settable packer 316 may be larger than the pressure below the mechanical compression-set, re-settable packer 316, the pressure above the mechanical compression-set, re-settable packer 316 can be readily reduced by performing a controlled flow-back of the just stimulated zone using the annulus between the jointed tubing 302 and the production casing 82; or by circulation of lower density fluid (e.g., nitrogen) down the jointed tubing 302 and up the annulus between the jointed tubing 302 and production casing 82.

The one-way full-opening flapper-type check valve sub 304 is preferred as this type of design accommodates unrestricted pumping of abrasive (or erosive) fluid downhole, and furthermore allows for passage of control balls that, depending on the specific detailed design of individual BHA components, may be dropped from the surface to control fluid flow and hydraulics of individual BHA components or provide for safety release of the BHA. Depending on the specific tool design, many different valving configurations could be deployed to provide the functionality provided by the flow control valves described in this embodiment.

As alternatives to this seventh embodiment, a sub containing a nipple could be included which could provide the capability of suspending and holding other measurement devices or BHA components. This nipple, for example, could hold a conventional casing-collar-locator and gamma-ray tool that is deployed via wireline and seated in the nipple to provide additional diagnostics of BHA position and location of formation intervals of interest. Additionally, multiple abrasive jetting tools can be deployed as part of the BHA to control perforation cutting characteristics, such as hole/slot size, cutting rate, to accommodate various abrasive materials, and/or to provide system redundancy in the event of premature component failure.

It will be recognized by those skilled in the art that many different components can be deployed as part of the bottomhole assembly. The bottomhole assembly may be configured to contain instrumentation for measurement of reservoir, fluid, and wellbore properties as deemed desirable for a given application. For example, temperature and pressure gauges could be deployed to measure downhole fluid temperature and pressure conditions during the course of the treatment; a densitometer could be used to measure effective downhole fluid density (which would be particularly useful for determining the downhole distribution and location of proppant during the course of a hydraulic proppant fracture treatment); and a radioactive detector system (e.g., gamma-ray or neutron measurement systems) could be used for locating hydrocarbon bearing zones or identifying or locating radioactive material within the wellbore or formation.

Depending on the specific bottomhole assembly components and whether the perforating device creates perforation holes with burrs that may damage the sealing mechanism, the bottomhole assembly could be configured with a "perforation burr removal" tool that would act to scrape and remove perforation burrs from the casing wall.

Depending on the specific bottomhole assembly components and whether excessive wear of bottomhole assembly components may occur if the assembly is run in contact with the casing wall, centralizer subs could be deployed on the bottomhole assembly to provide positive mechanical positioning of the assembly and prevent or minimize the potential for damage due to the assembly running in contact with the casing wall.

Depending on the specific bottomhole assembly components and whether the perforation charges create severe shock waves and induce undue vibrations when fired, the bottomhole assembly may be configured with vibration/shock dampening subs that would eliminate or minimize any adverse effects on system performance due to perforation charge detonation.

Depending on the deployment system used and the objectives of a particular job, perforating devices and any other desired BHA components may be positioned either above or below the re-settable sealing mechanism and in any desired order relative to each other. The deployment system itself, whether it be wireline, electric line, coiled tubing, conventional jointed tubing, or downhole tractor may be used to convey signals to activate the sealing mechanism and/or perforating device. It would also be possible to suspend such signaling means within conventional jointed tubing or coiled tubing used to suspend the sealing and perforating devices themselves. Alternatively, the signaling means, whether it be electric, hydraulic, or other means, could be run in the hole externally to the suspension means or even housed in or comprised of one or more separate strings of coiled tubing or conventional jointed tubing.

With respect to treatments that use high viscosity fluid systems in wells deeper than about 8,000 feet, several major technological and economic benefits are immediately derived from application of this new invention. Reducing the friction pressure limitations allows treatment of deeper wells and reduces the requirement for special fracture fluid formulations. Friction pressure limitations are reduced or eliminated because the high viscosity fluid can be pumped down the annulus between the coiled tubing or other suspension means and production casing. Since friction pressure limitations can be reduced or eliminated from that experienced with pumping high viscosity fluid systems down the interior of coiled tubing, well depths where this technique can be applied are substantially increased. For example, assuming 1-½-inch coiled tubing deployed in a 5-½-inch outer diameter 17-pound-per-foot casing, the effective cross-sectional flow area is approximately equivalent to a 5-inch outer diameter casing string. With this effective cross-sectional flow area, well depths on the order of 20,000 feet or greater could be treated and higher pump rates (e.g., on the order of 10 to 30-barrels-per-minute or more) could be achieved for effective proppant transport and hydraulic fracturing using high viscosity fluids.

Since the annulus typically may have greater equivalent flow area, conventional fracturing fluids can be used, as opposed to special low-viscosity fluids (such as Dowell-Schlumberger's ClearFrac™ fluid) used to reduce friction pressure drop through coiled tubing. The use of conventional fracturing fluid technology would then allow treatment of formations with temperatures greater than 250° F., above which currently available higher-cost specialty fluids may begin to degrade.

The sealing mechanism used could be an inflatable device, a mechanical compression-set re-settable packer, a mechanical compression-set straddle-packer design, cup-seal devices, or any other alternative device that may be deployed via a suspension means and provides a re-settable hydraulic sealing capability or equivalent function. Both inflatable and compression set devices exist that provide radial clearance between seals and casing wall (e.g., on the order of 0.25-inches to 1-inch for inflatable devices or 0.1–0.2 inches for compression-set devices) such that seal wear and tear would be drastically reduced or eliminated altogether. In a preferred embodiment of this invention, there would be sufficient clearance between the sealing mechanism in its deactivated state and the casing wall to allow rapid movement into and out of the wellbore without significant damage to the sealing mechanism or without pressure control issues related to surging/swabbing the well due to tool movement. The increased clearance between the seal surface and the casing wall (when the seal is not actuated) would also allow the coiled tubing/BHA to be tripped in and out of the hole at much faster speeds than are possible with currently available coiled tubing systems. In addition, to minimize potential undesirable seal wear and tear, in a preferred embodiment, the perforating device would accommodate perforating the casing wall such that a perforation hole with a relatively smooth edge would be achieved. Alternatively, the mechanical re-settable sealing mechanism may not need to provide a perfect hydraulic seal and for example, could retain a small gap around the circumference of the device. This small gap could be sized to provide a sealing mechanism (if desired) whereby proppant bridges across the small gap and provides a seal (if desired) that can be removed by fluid circulation. Furthermore depending on the specific application, it is possible that a stimulation job could proceed in an economically viable fashion even if a perfect hydraulic seal was not obtained with the mechanical re-settable sealing mechanism.

Since the perforating device is deployed simultaneously with the re-settable sealing mechanism, all components can be depth controlled at the same time by the same measurement standard. This eliminates depth control problems that existing methods experience when perforation operations and stimulation operations are performed using two different measurement systems at different times and different wellbore trips. Very precise depth control can be achieved by use of a casing-collar-locator, which is the preferred method of depth control.

The gross height of each of the individual perforated target intervals is not limited. This is in contrast to the problem that existing coiled tubing systems possess using a straddle-packer like device that limits application to 15–30 feet of perforated interval height.

Since permanent bridge plugs are not necessarily used, the incremental cost and wellbore risk associated with bridge plug drill-out operations is eliminated.

If coiled tubing is used as the deployment means, it is possible that the coiled tubing string used for the stimulation job could be hung-off in the wellhead and used as the production tubing string, which could result in significant cost savings by eliminating the need for rig mobilization to the well-site for installation of conventional production tubing string comprised of jointed tubing.

Controlling the sequence of zones to be treated allows the design of individual treatment stages to be optimized based on the characteristics of each individual zone. Furthermore, the potential for sub-optimal stimulation because multiple zones are treated simultaneously is essentially eliminated by having only one open set of perforations exposed to each stage of treatment. For example, in the case of hydraulic fracturing, this invention may minimize the potential for overflush or sub-optimal placement of proppant into the fracture. Also, if a problem occurs such that the treatment must be terminated, the up-hole zones to be stimulated have not been compromised, since they have yet to be perforated. This is in contrast to conventional ball sealer or coiled tubing stimulation methods, where all perforations must be shot prior to the job. Should the conventional coiled tubing job fail, it may be extremely difficult to effectively divert and stimulate over a long completion interval. Additionally, if only one set of perforations is open above the sealing element, fluid can be circulated without the possibility of breaking down the other multiple sets of open perforations above the top sealing element as could occur in the conventional coiled tubing job. This can minimize or eliminate fluid loss and damage to the formation when the bottomhole circulation pressure would otherwise exceed the formation pore pressure.

The entire treatment can be pumped in a single trip, resulting in significant cost savings over other techniques that require multiple wireline or rig work to trip in and out of the hole in between treatment stages.

The invention can be applied to multi-stage treatments in deviated and horizontal wellbores. Typically, other conventional diversion technology in deviated and horizontal wellbores is more challenging because of the nature of the fluid transport of the diverter material over the long intervals typically associated with deviated or horizontal wellbores.

Should a screen-out occur during the fracture treatment, the invention provides a method for sand-laden fluid in the annulus to be immediately circulated out of the hole such that stimulation operations can be recommenced without having to trip the coiled tubing/BHA out of the hole. The presence of the coiled tubing system provides a means to measure bottomhole pressure after perforating or during stimulation operations based on pressure calculations involving the coiled tubing string under shut-in (or low-flow-rate) conditions.

The presence of the coiled tubing or conventional jointed tubing system, if used as the deployment means, provides a means to inject fluid downhole independently from the fluid injected in the annulus. This may be useful, for example, in additional applications such as: (a) keeping the BHA sealing mechanism and flow ports clean of proppant accumulation (that could possibly cause tool sticking) by pumping fluid downhole at a nominal rate to clean off the sealing mechanism and flow ports; (b) downhole mixing applications (as discussed further below); (c) spotting of acid downhole during perforating to aid perforation hole clean-up and communication with the formation; and (d) independently stimulating two zones isolated from each other by the re-settable sealing mechanism. As such, if tubing is used as the deployment means, depending on the specific operations desired and the specific bottomhole assembly components, fluid could be circulated downhole at all times; or only when the sealing element is energized, or only when the sealing element is not energized; or while equalization ports are open or closed. Depending on the specific bottomhole assembly components and the specific design of downhole flow control valves, as may be used for example as integral components of equalization ports subs, circulation port subs or flow port subs, downhole flow control valves may be operated by wireline actuation, hydraulic actuation, flow actuation, "j-latch" actuated, sliding-sleeve actuated, or by many other means known to those skilled in the art of operation and actuation of downhole flow control valves.

The coiled tubing system still allows for controlled flowback of individual treatment stages to aid clean up and assist fracture closure. Flowback can be performed up the annulus between the coiled tubing and the production casing, or alternatively, flowback may even be performed up the coiled tubing string if excessive proppant flowback were not to be considered a problem.

The perforating device may be comprised of commercially-available perforating systems. These gun systems could include what will be referred to herein as a "select-fire" system such that a single perforation gun assembly is comprised of multiple charges or sets of perforation charges. Each individual set of one or more perforation charges can be remotely controlled and fired from the surface using electric, radio, pressure, fiber-optic or other actuation signals. Each set of perforation charges can be designed (number of charges, number of shots per foot, hole size, penetration characteristics) for optimal perforation of the individual zone that is to be treated with an individual stage. With current select-fire gun technology, commercial gun systems exist that could allow on the order of 30 to 40 intervals to be perforated sequentially in a single downhole trip. Guns can be pre-sized and designed to provide for firing of multiple sets of perforations. Guns can be located at any location on the bottomhole assembly, including either above or below the mechanical re-settable sealing mechanism.

Intervals may be grouped for treatment based on reservoir properties, treatment design considerations, or equipment limitations. After each group of intervals (preferably 5 to approximately 20), at the end of a workday (often defined by lighting conditions), or if difficulties with sealing one or more zones are encountered, a bridge plug or other mechanical device would preferably be used to isolate the group of intervals already treated from the next group to be treated. One or more select-fire set bridge plugs or fracture baffles could be run in conjunction with the bottomhole assembly and set as desired during the course of the completion operation to provide positive mechanical isolation between perforated intervals and eliminate the need for a separate wireline run to set mechanical isolation devices or diversion agents between groups of fracture stages.

In general, the inventive method can be readily employed in production casings of 4-½ inch diameter to 7-inch diameter with existing commercially available perforating gun systems and mechanical re-settable sealing mechanisms. The inventive method could be employed in smaller or larger casings with mechanical re-settable sealing mechanisms appropriately designed for the smaller or larger casings.

If select-fire perforating guns are used, each individual gun may be on the order of 2 to 8 feet in length, and contain on the order of 8 to 20 perforating charges placed along the gun tube at shot density ranging between 1 and 6 shots per foot, but preferably 2 to 4 shots per foot. In a preferred embodiment, as many as 15 to 20 individual guns could be stacked one on top of another such that the assembled gun system total length is preferably kept to less than approximately 80 to 100 feet. This total gun length can be run into the wellbore using a readily-available surface crane and lubricator system. Longer gun lengths could also be used, but may require additional or special surface equipment depending on the total number of guns that would make up the complete perforating device. It is noted that in some unique applications, gun lengths, number of charges per gun, and shot density could be greater or less than as specified above as final perforating system design would be impacted by the specific formation characteristics present in the wellbore to stimulated.

In order to minimize the total length of the gun system and BHA, it may be desirable to use multiple (two or more) charge carriers uniformly distributed around and strapped, welded, or otherwise attached to the coiled tubing or connected below the mechanical re-settable sealing mechanism. For example, if it were desired to stimulate 30 zones, where each zone is perforated with a 4-ft gun, a single gun assembly would result in a total length of approximately 150 feet, which may be impractical to handle at the surface. Alternatively, two gun assemblies located opposite one another on the coiled tubing could be deployed, where each assembly could contain 15 guns, and total length could be approximately 75-feet, which could readily be handled at the surface with existing lubricator and crane systems.

An alternative arrangement for the perforating gun or guns would be to locate one or more guns above the re-settable mechanical sealing mechanism. There could be two or more separate gun assemblies attached in such a way that the charges were oriented away from the components on the bottomhole assembly or the coiled tubing. It could also be a single assembly with charges loaded more densely and firing mechanisms designed to simultaneously fire only a subset of the charges within a given interval, perhaps all at a given phase orientation.

Although the perforating device described in this embodiment used remotely fired charges or fluid jetting to perforate the casing and cement sheath, alternative perforating devices including but not limited to chemical dissolution or drilling/milling cutting devices could be used within the scope of this invention for the purpose of creating a flow path between the wellbore and the surrounding formation. For the purposes of this invention, the term "perforating device" will be used broadly to include all of the above, as well as any actuating device suspended in the wellbore for the purpose of actuating charges or other perforating means that may be conveyed by the casing or other means external to the bottomhole assembly or suspension method used to support the bottomhole assembly.

The BHA could contain a downhole motor or other mechanism to provide rotation/torque to accommodate actuation of mechanical sealing mechanisms requiring rotation/torque for actuation. Such a device, in conjunction with an orienting device (e.g., gyroscope or compass) could allow oriented perforating such that perforation holes are placed in a preferred compass direction. Alternatively, if conventional jointed tubing were to be used, it is possible that rotation and torque could be transmitted downhole by direct rotation of the jointed tubing using rotation drive equipment that may be readily available on conventional workover rigs. Downhole instrumentation gauges for measurement of well conditions (casing collar locator, pressure, temperature, pressure, and other measurement gauges) for real-time downhole monitoring of stimulation job parameters, reservoir properties, and/or well performance could also be deployed as part of the BHA.

In addition to the re-settable mechanical diversion device, other diversion material/devices could be pumped downhole during the treatment including but not limited to ball sealers or particulates such as sand, ceramic material, proppant, salt, waxes, resins, or other organic or inorganic compounds or by alternative fluid systems such as viscosified fluids, gelled fluids, foams, or other chemically formulated fluids or other injectable diversion agents. The additional diversion material could be used to help minimize the duration of the stimulation treatment as some time savings could be realized by reducing the number of times the mechanical diversion device is set, while still achieving diversion capabilities over the multiple zones. For example in a 3,000 foot interval where individual zones nominally 100 feet apart are to be treated, it may be desirable to use the re-settable mechanical diversion device working in 500 foot increments uphole, and then divert each of the six stages with a diverting agent carried in the treating fluid. Alternatively, limited entry techniques could be used for multiple intervals as a subset of the gross interval desired to be treated. Either of these variations would decrease the number of mechanical sets of the mechanical diversion device and possibly extend its effective life.

If a tubing string is used as the deployment means, the tubing allows for deployment of downhole mixing devices and ready application of downhole mixing technology. Specifically, the tubing string can be used to pump chemicals downhole and through the flow ports in the bottomhole assembly to subsequently mix with the fluid pumped in the tubing by production casing annulus. For example, during a hydraulic fracturing treatment, it may be desirable to pump nitrogen or carbon dioxide downhole in the tubing and have it mix with the treatment fluid downhole, such that nitrogen-assisted or carbon dioxide-assisted flowback can be accommodated.

This method and apparatus could be used for treatment of vertical, deviated, or horizontal wellbores. For example, the invention provides a method to generate multiple vertical (or somewhat vertical) fractures to intersect horizontal or deviated wellbores. Such a technique could enable economic completion of multiple wells from a single pad location. Treatment of a multi-lateral well could also be performed wherein the deepest lateral is treated first; then a plug is set or sleeve actuated to isolate this lowest lateral; the next up-hole lateral is then treated; another plug is set or sleeve actuated to isolate this lateral; and the process repeated to treat the desired number of laterals within a single wellbore.

If select-fire perforating guns are used, although desirable from the standpoint of maximizing the number of intervals that can be treated, the use of short guns (i.e., 4-ft length or less) could limit well productivity in some instances by inducing increased pressure drop in the near-wellbore reservoir region when compared to use of longer guns. Well productivity could similarly be limited if only a short interval (i.e., 4-ft length or less) is perforated using abrasive jetting. Potential for excessive proppant flowback may also be increased leading to reduced stimulation effectiveness. Flowback would preferably be performed at a controlled low-rate to limit potential proppant flowback. Depending on flowback results, resin-coated proppant or alternative gun configurations could be used to improve the stimulation effectiveness.

In addition, if tubing or cable are used as the deployment means to help mitigate potential undesirable proppant erosion on the tubing or cable from direct impingement of the proppant-laden fluid when pumped into the side-outlet injection ports, an "isolation device" can be rigged up on the wellhead. The isolation device may consists of a flange with a short length of tubing attached that runs down the center of the wellhead to a few feet below the injection ports. The bottomhole assembly and tubing or cable are run interior to the isolation device tubing. Thus the tubing of the isolation device deflects the proppant and isolates the tubing or cable from direct impingement of proppant. Such an isolation device would consist of an appropriate diameter tubing such that it would readily allow the largest outer diameter dimension associated with the tubing or cable and bottomhole assembly to pass through unhindered. The length of the isolation device would be sized such that in the event of damage, the lower master fracture valve could still be closed and the wellhead rigged down as necessary to remove the isolation tool. Depending on the stimulation fluids and the method of injection, an isolation device would not be needed if erosion concerns were not present. Although field tests of isolation devices have shown no erosion problems, depending on the job design, there could be some risk of erosion damage to the isolation tool tubing assembly resulting in difficulty removing it. If an isolation tool is used, preferred practices would be to maintain impingement velocity on the isolation tool substantially below typical erosional limits, preferably below about 180 ft/sec, and more preferably below about 60 ft/sec.

Another concern with this technique is that premature screen-out may occur if fluid displacement during pumping is not adequately measured as it may be difficult to initiate a fracture with proppant-laden fluid across the next zone to be perforated. It may be preferable to use a KCl fluid or some other non-gelled fluid or fluid system for the pad rather than a gelled pad fluid to better initiate fracturing of the next zone. Pumping the job at a higher rate with a non-gelled fluid between stages to achieve turbulent flush/sweep of the casing will minimize the risk of proppant screen-out. Also, contingency guns available on the tool string would allow continuing the job after an appropriate wait time.

Although the embodiments discussed above are primarily related to the beneficial effects of the inventive process when applied to hydraulic fracturing processes, this should not be interpreted to limit the claimed invention which is applicable to any situation in which perforating and performing other wellbore operations in a single trip is beneficial. Those skilled in the art will recognize that many variations not specifically mentioned in the examples will be equivalent in function for the purposes of this invention.

We claim:

1. A method of perforating and treating multiple intervals of one or more subterranean formations intersected by a wellbore, said method comprising:

(a) deploying a bottom-hole assembly ("BHA") using a tubing string within said wellbore, said BHA having a perforating device, a sealing mechanism and at least one pressure equalization means;

(b) using said perforating device to perforate an interval of said one or more subterranean formations;

(c) actuating said sealing mechanism so as to establish a hydraulic seal in said wellbore;

(d) pumping a treating fluid down the annulus between said tubing string and said wellbore and into the perforations created by said perforating device, without removing said bottom-hole assembly from said wellbore;

(e) establishing pressure communication between the portions of the wellbore above and below said sealing mechanism through said at least one pressure equalization means;

(f) releasing said sealing mechanism; and (g) repeating steps (b) through (f) for at least one additional interval of said one or more subterranean formations.

2. The method of claim 1 wherein said tubing string is a coiled tubing.

3. The method of claim 1 wherein said tubing string is a jointed tubing.

4. The method of claim 1 wherein said BHA further comprises a depth-control device selected from the group consisting of a casing collar locator and a surface measurement system.

5. The method of claim 1 wherein said hydraulic seal is established below said perforated interval.

6. The method of claim 1 wherein said perforating device is a select-fire perforating gun containing multiple sets of one or more shaped-charge perforating charges; each of said sets of one or more shaped-charge perforating charges individually controlled and activated by electric or optic signal transmitted via a cable deployed in the wellbore.

7. The method of claim 1 wherein said treating fluid is also pumped down said tubing string, through flow ports in said BHA, and into said perforations.

8. The method of claim 7 herein a second treating fluid is pumped down said tubing string, through flow ports in said BHA, and into said perforations.

9. The method of claim 8 wherein said second treating fluid comprises nitrogen.

10. The method of claim 1 wherein said sealing mechanism is a re-settable packer.

11. The method of claim 1 wherein said treating fluid is a slurry of a proppant material and a carder fluid.

12. The method of claim 1 wherein said treating fluid is a fluid containing no proppant.

13. The method of claim 1 wherein said treating fluid comprises an acid solution.

14. The method of claim 1 wherein said treating fluid comprises an organic solvent.

15. The method of claim 1 wherein said method further comprises the step of, prior to releasing said sealing mechanism, deploying at least one diversion agent in said wellbore to block further flow of treating fluid into said perforations.

16. The method of claim 15 wherein said diversion agent deployed in said wellbore is selected from the group consisting of particulates, gels, viscous fluids, foams, and ball sealers.

17. The method of claim 1 wherein said sealing mechanism is actuated by signaling means.

18. The method of claim 1 wherein said perforating device is actuated by signaling means.

19. A method of perforating and treating multiple intervals of one or more subterranean formations intersected by a wellbore, said method comprising:

(a) deploying a bottom-hole assembly ("BHA") using a deployment means selected from the group consisting of a wireline, a slickline, and a cable, said BHA having a perforating device, a sealing mechanism and at least one pressure equalization means;

(b) using said perforating device to perforate an interval of said one or more subterranean formations;

(c) actuating said sealing mechanism so as to establish a hydraulic seal in said wellbore;

(d) pumping a treating fluid in said wellbore;

(e) establishing pressure communication between the portions of the wellbore above and below said scaling mechanism through said at least one pressure equalization means;

(f) releasing said sealing mechanism; and (h) repeating steps (b) through (f) for at least one additional interval of said one or more subterranean formations.

20. A stimulation treatment system for use in perforating and treating multiple intervals of one or more subterranean formations intersected by a wellbore, said system comprising:

(a) a treating fluid;

(b) a tubing string for deployment within said wellbore;

(c) means for pumping said treating fluid down the annulus between said tubing string and said wellbore;

(d) a bottom-hole assembly (BHA) adapted to be deployed in said wellbore with said tubing siring, said BHA having at least one perforating device for sequentially perforating said multiple intervals, at least one sealing mechanism, and at least one pressure equalization means, said BHA capable of being positioned within said wellbore, to allow actuation of said perforating device, said sealing mechanism and said pressure equalization means;

(e) said sealing mechanism capable of establishing a hydraulic seal in said wellbore, said pressure equalization means capable of establishing pressure communication between portions of said wellbore above and below said sealing mechanism, and said sealing mechanism farther capable of releasing said hydraulic seal to allow said BHA to move to a different position within said wellbore, thereby allowing each of said multiple treatment intervals to be treated with said treating fluid separately from said other treatment intervals.

21. The system of claim 20, wherein said pumping means also pumps said treating fluid down said tubing string through flow ports in said BHA, and into the perforations.

22. The system of claim 21, further comprising a second treating fluid, and wherein said pumping means also pumps said second treating fluid down said tubing string, through said flow ports in maid BHA, and into said perforations.

23. The system of claim 20 wherein said tubing string is coiled tubing.

24. The system of claim 20 wherein said tubing string is jointed tubing.

25. The system of claim 20 wherein said BHA further comprises a depth-control device selected from the group consisting of a casing collar locator and a surface measurement system.

26. The system of claim 20 wherein said hydraulic seal is established below said sealing mechanism.

27. The system of claim 20 wherein said perforating device is a select-fire perforating gnu containing multiple set, of one more shaped-charge perforating charges; each of said sets of one or more shaped-charge perforating charges individually controlled and activated by an electric or optic signal transmitted via a cable deployed in the wellbore.

28. The system of claim 20 wherein said sealing mechanism is actuated by signaling means.

29. The system of claim 20 wherein said perforating device is actuated by signaling means.

30. The system of claim 20 wherein said sealing mechanism is a re-settable packer.

31. The system of claim 20 wherein said treating fluid is a slurry of a proppant material and a carrier fluid.

32. The system of claim 20 wherein said treating fluid is a fluid containing no proppant.

33. The system of claim 20 wherein said treating fluid comprises an acid solution.

34. The system of claim 20 wherein said treating fluid comprises an organic solvent.

35. A stimulation treatment system for use in perforating and treating multiple intervals of one or more subterranean formations intersected by a wellbore, said system comprising:

(a) a treating fluid;

(b) a deployment means deployed within said wellbore, said deployment means being selected from the group consisting of a wireline, a slickline, and a cable;

(c) a bottom-hole assembly (BHA) adapted to be deployed in said wellbore with said deployment means, said BHA having at least one perforating device for sequentially perforating said multiple intervals, at least one sealing mechanism, and at least one pressure equalization means, said BHA capable of being positioned within said wellbore, to allow actuation of said perforating device, said sealing mechanism and said pressure equalization means;

(d said sealing mechanism capable of establishing a hydraulic seal in said wellbore, said pressure equalization means capable of establishing pressure communication between portions of said wellbore above and below said sealing mechanism, and said sealing mechanism further capable of releasing said hydraulic seal to allow said BHA to move to a different position within said wellbore, thereby allowing each of said multiple treatment intervals to be treated with said treating fluid separately from said other treatment intervals.

36. An apparatus for use in perforating and treating multiple intervals of one or more subterranean formations intersected by a wellbore, said apparatus comprising:

(a) a bottom-hole assembly (BHA), having a tubing string for deployment in said wellbore, said BHA having at leant one perforating device for sequentially perforating said multiple intervals, at least one sealing mechanism and at least one pressure equalization means; and (b) said sealing mechanism capable of establishing a hydraulic seal in said wellbore said pressure equalization means capable of establishing pressure communication between portions of said wellbore above and below said sealing mechanism, and said sealing mechanism further capable of releasing maid hydraulic seal to allow said BHA to move to a different position within said wellbore, thereby allowing each of said multiple treatment intervals to be treated separately from said other treatment intervals; and (c) a means for pumping treating fluid down the annular region between said tubing string and said wellbore.

37. The apparatus of claim 36 wherein said tubing siring is a coiled tubing.

38. The apparatus of claim 36 wherein said tubing stung is jointed tubing.

39. The apparatus of claim 36 wherein said BHA further comprises a depth-control device selected from the group consisting of a casing collar locator and a surface measurement system.

40. The apparatus of claim 36 wherein said sealing mechanism is a re-settable packer.

41. The apparatus of claim 36 wherein said hydraulic seal is established below said at least one perforated interval.

42. The apparatus of claim 36 wherein said perforating device is a select-fire perforating gun containing multiple sets of one or more shaped-charge perforating charges; each of said sets of one or more shaped-charge perforating charges individually controlled and activated by an electric signal transmitted via a wireline deployed in the wellbore.

43. The apparatus of claim 36 wherein said scaling mechanism is actuated by signaling means.

44. The apparatus of claim 36 wherein said perforating device is actuated by signaling means.

45. An apparatus for use in perforating and treating multiple intervals of one or more subterranean formations intersected by a wellbore, said apparatus comprising:

(a) a bottom-hole assembly (BHA), adapted to be deployed in said wellbore by a deployment means selected from the group consisting of a wireline, a slickline, and a cable; said BHA having at least one perforating device for sequentially perforating said multiple intervals, at least one sealing mechanism and at least one pressure equalization means; and (b) said sealing mechanism capable of establishing a hydraulic seal in said wellbore, said pressure equalization means capable of establishing pressure communication between portions of said wellbore above and below said sealing mechanism, and said sealing mechanism further capable of releasing said hydraulic seal to allow said BHA to move to a different position within said wellbore thereby allowing each of said multiple treatment intervals to be treated separately from said other treatment intervals.

46. An apparatus for use in perforating and treating multiple intervals of one or more subterranean formations intersected by a wellbore, said apparatus comprising:

(a) a bottom-hole assembly (BHA), adapted to be deployed in said wellbore by a deployment means, said BHA having at leant one perforating device for sequentially perforating said multiple intervals, at least one sealing mechanism, at least one pressure equalization means, and a depth-control device selected from the group consisting of a casing collar locator and a surface measurement system; and (b) said scaling mechanism capable of establishing a hydraulic seal in said wellbore, said pressure equalization moans capable of establishing pressure communication between portions of said wellbore above and below said sealing mechanism, and said sealing mechanism further capable of releasing said hydraulic seal to allow said BHA to move to a different position within said wellbore, thereby allowing each of said multiple treatment intervals to be treated separately from said other treatment intervals.

47. A stimulation treatment system for use in perforating and treating multiple intervals of one or more subterranean formations intersected by a wellbore, said system comprising:

(a) a treating fluid;

(b) a deployment means deployed within said wellbore, (c) a bottom-hole assembly (BHA) adapted to be deployed in said wellbore with said deployment means, said BHA having at least one perforating device for sequentially perforating said multiple intervals, at least one scaling mechanism, at least one pressure equalization means, and a depth-control device selected from the group consisting of a casing collar locator and a surface measurement system, said BHA capable of being positioned within said wellbore, to allow actuation of said perforating device, said sealing mechanism and said pressure equalization means;

(d) said sealing mechanism capable of establishing a hydraulic seal in said wellbore, said pressure equalization means capable of establishing pressure communication between portions of said wellbore above and below said sealing mechanism, and said sealing mechanism further capable of releasing said hydraulic seal to allow said BHA to move to a different position within said wellbore, thereby allowing each of said multiple treatment intervals to be treated with said treating fluid separately from maid other treatment intervals.

48. A method of perforating and treating multiple intervals of one or more subterranean formations intersected by a wellbore, said method comprising:

(a) deploying a bottom-hole assembly ("BHA") using deployment means within said wellbore, said BHA having a perforating device, a sealing mechanism, at least one pressure equalization means, and a depth-control device selected from the group consisting of a casing collar locator and a surface measurement system;

(b) using said perforating device to perforate an interval of said one or more subterranean formations;

(c) actuating said sealing mechanism so as to establish a hydraulic seal in said wellbore;

(d) pumping a treating fluid in said wellbore and into the perforations created by said perforating device, without removing said performing device from said wellbore;

(e) establishing pressure communication between the portions of the wellbore above and below said sealing mechanism through said at least one pressure equalization means;

(f) releasing said sealing mechanism; and (g) repeating steps (b) through (f) for at least one additional interval of said one or more subterranean formations.

* * * * *